US009540912B2

(12) United States Patent
Fripp et al.

(10) Patent No.: US 9,540,912 B2
(45) **Date of Patent: *Jan. 10, 2017**

(54) WIRELESS ACTIVATABLE VALVE ASSEMBLY

(71) Applicant: HALLIBURTON ENERGY SERVICES, INC., Houston, TX (US)

(72) Inventors: Michael L. Fripp, Carrollton, TX (US); Aaron J. Bonner, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 310 days.

This patent is subject to a terminal disclaimer.

(21) Appl. No.: 14/126,418

(22) PCT Filed: Feb. 15, 2013

(86) PCT No.: PCT/US2013/026534

§ 371 (c)(1),
(2) Date: Dec. 14, 2013

(87) PCT Pub. No.: WO2014/123549

PCT Pub. Date: Aug. 14, 2014

(65) Prior Publication Data

US 2014/0262321 A1 Sep. 18, 2014

Related U.S. Application Data

(63) Continuation of application No. PCT/US2013/025424, filed on Feb. 8, 2013.

(51) Int. Cl.
*E21B 34/06* (2006.01)
*E21B 43/08* (2006.01)

(52) U.S. Cl.
CPC ..... *E21B 43/08* (2013.01); *E21B 34/066* (2013.01)

(58) Field of Classification Search
CPC ..... E21B 34/066; E21B 34/06; E21B 34/00; E21B 2034/007; E21B 43/08
See application file for complete search history.

(56) References Cited

U.S. PATENT DOCUMENTS 5,008,664 A 4/1991 More et al.
5,058,674 A 10/1991 Schultz et al.
(Continued)

FOREIGN PATENT DOCUMENTS

EP 2208854 A2 7/2010
WO 2004003329 A2 1/2004
(Continued)

OTHER PUBLICATIONS

Foreign Communication from a Related Counterpart Application, International Search Report and Written Opinion dated Oct. 16, 2013, International Application No. PCT/US13/26534 filed on Feb. 15, 2013.

(Continued)

*Primary Examiner* — Yong-Suk (Philip) Ro
(74) *Attorney, Agent, or Firm* — Scott Richardson; Baker Botts L.L.P.

(57) ABSTRACT

A wireless actuation system comprises a transmitter, an actuation system comprising a receiving antenna, and one or more sliding members transitional from a first position to a second position. The transmitter is configured to transmit an electromagnetic signal, and the sliding member prevents a route of fluid communication via one or more ports of a housing when the sliding member is in the first position. The sliding member allows fluid communication via the one or more ports of the housing when the sliding member is in the second position, and the actuation system is configured to allow the sliding member to transition from the first position (Continued)

to the second position in response to recognition of the electromagnetic signal by the receiving antenna.

18 Claims, 9 Drawing Sheets

(56) References Cited

U.S. PATENT DOCUMENTS

| | | | | |
|---|---|---|---|---|
| 5,531,270 | A | 7/1996 | Fletcher et al. | |
| 5,971,072 | A | 10/1999 | Huber et al. | |
| 6,172,614 | B1 | 1/2001 | Robison et al. | |
| 6,192,988 | B1 | 2/2001 | Tubel | |
| 6,364,037 | B1 | 4/2002 | Brunnert et al. | |
| 7,055,592 | B2 | 6/2006 | Bass et al. | |
| 7,073,594 | B2 | 7/2006 | Stegemeier et al. | |
| 7,098,802 | B2 | 8/2006 | Hall et al. | |
| 7,503,398 | B2 | 3/2009 | LoGiudice et al. | |
| 7,681,652 | B2 | 3/2010 | Gaudette et al. | |
| 8,169,337 | B2 | 5/2012 | Evans et al. | |
| 2001/0013410 | A1 | 8/2001 | Beck et al. | |
| 2003/0024704 | A1 | 2/2003 | Hirsch et al. | |
| 2003/0029611 | A1 | 2/2003 | Owens | |
| 2004/0231853 | A1 | 11/2004 | Anyan et al. | |
| 2006/0131030 | A1 | 6/2006 | Sheffield | |
| 2007/0227731 | A1 | 10/2007 | Contant | |
| 2007/0235199 | A1 | 10/2007 | LoGiudice et al. | |
| 2007/0285275 | A1 | 12/2007 | Purkis et al. | |
| 2008/0025148 | A1 | 1/2008 | Camwell et al. | |
| 2008/0283238 | A1 | 11/2008 | Richards et al. | |
| 2009/0151925 | A1 | 6/2009 | Richards et al. | |
| 2010/0243243 | A1 | 9/2010 | Chen et al. | |
| 2010/0314562 | A1* | 12/2010 | Bisset | E21B 34/06 251/12 |
| 2011/0030969 | A1 | 2/2011 | Richards | |
| 2011/0232917 | A1 | 9/2011 | Skinner et al. | |
| 2011/0297393 | A1 | 12/2011 | Patel | |
| 2012/0026003 | A1 | 2/2012 | Layton | |
| 2012/0037360 | A1 | 2/2012 | Arizmendi, Jr. et al. | |
| 2012/0048561 | A1 | 3/2012 | Holderman | |
| 2012/0051189 | A1 | 3/2012 | Signorelli et al. | |
| 2012/0067594 | A1 | 3/2012 | Noske et al. | |
| 2014/0338922 | A1* | 11/2014 | Lopez | E21B 34/066 166/373 |

FOREIGN PATENT DOCUMENTS

| | | | |
|---|---|---|---|
| WO | 2014004144 | A2 | 3/2014 |
| WO | 2014123539 | A1 | 8/2014 |

OTHER PUBLICATIONS

Foreign Communication from a Related Counterpart Application, International Search Report and Written Opinion dated Oct. 15, 2013, International Application No. PCT/US13/25424 filed on Feb. 8, 2013.

Fripp, Michael L., International Application entitled, "Wireless Activatable Valve Assembly" filed on Feb. 8, 2013, PCT Serial No. PCT/US13/25424.

Fripp, Michael L., Application entitled, "Wireless Activatable Valve Assembly" filed Apr. 7, 2014, U.S. Appl. No. 14/350,358.

Extended European Search Report issued in related EP Application No. 13874454.5, mailed Jul. 7, 2016 (7 pages).

Office Action issued in related Singapore Application No. 11201504424T, mailed Jul. 25, 2016 (7 pages).

Office Action issued in related Canadian Application No. 2897435, mailed May 13, 2016 (6 pages).

Office Action issued in related Canadian Application No. 2897449, mailed May 16, 2016 (6 pages).

Extended European Search Report issued in related European Application No. 13874507.0, mailed Oct. 25, 2016 (9 pages).

* cited by examiner

WIRELESS ACTIVATABLE VALVE ASSEMBLY

CROSS-REFERENCE TO RELATED APPLICATIONS

This application is a filing under 35 U.S.C. 371 as the National Stage of International Application No. PCT/US2013/026534, filed Feb. 15, 2013, entitled "Wireless Activatable Valve Assembly," by Michael L. Fripp, et al., which is a continuation under 35 U.S.C. 120 of and claims the benefit of International Application No. PCT/US2013/025424, filed Feb. 8, 2013, entitled "Wireless Activatable Valve Assembly," by Michael L. Fripp, et al., both of which are incorporated herein by reference in their entirety for all purposes.

BACKGROUND

When wellbores are prepared for oil and gas production, it is common to cement a casing string within the wellbore. Often, it may be desirable to cement the casing string within the wellbore in multiple, separate stages. The casing string may be run into the wellbore to a predetermined depth. Various "zones" in the subterranean formation may be isolated via the operation of one or more packers, which may also help to secure the casing string and stimulation equipment in place, and/or via cement.

Following the placement of the casing string, it may be desirable to provide at least one route of fluid communication out of the casing string. Conventionally, the methods and/or tools employed to provide fluid pathways out of the casing string require mechanical tools supplied by a rig and/or downhole tools needing high temperature protection, long term batteries, and/or wired surface connections. Additionally, conventional methods may not allow for individual, or at least selective, activation of a route of fluid communication from a plurality of formation zones.

SUMMARY

In an embodiment, a wireless actuation system comprises a transmitter, an actuation system comprising a receiving antenna, and one or more sliding members transitional from a first position to a second position. The transmitter is configured to transmit an electromagnetic signal, and the sliding member prevents a route of fluid communication via one or more ports of a housing when the sliding member is in the first position. The sliding member allows fluid communication via the one or more ports of the housing when the sliding member is in the second position, and the actuation system is configured to allow the sliding member to transition from the first position to the second position in response to recognition of the electromagnetic signal by the receiving antenna.

In an embodiment, a wireless actuation system comprises a receiving antenna, an actuation mechanism coupled to the receiving antenna, a pressure chamber, and a slidable component disposed in a downhole tool. The receiving antenna is configured to generate an electric current in response to receiving a signal, and the actuation mechanism is configured to selectively trigger fluid communication between the pressure chamber and the slidable component using the electric current. The slidable component is configured to transition from a first position to a second position based on a pressure differential between the pressure chamber and a second pressure source.

In an embodiment, an actuation system for a downhole component comprises a powered transmitter comprising a transmitting antenna, and a downhole component comprising a central flowbore and a receiving antenna coupled to an actuation system. The powered transmitter is configured to be received within the central flowbore, and the transmitting antenna is configured to transmit a signal. The receiving antenna is configured to generate an electric current in response to receiving the signal from the transmitting antenna, and the actuation system is configured to actuate using the electric current from the receiving antenna.

In an embodiment, a method of actuating a downhole component comprises passing a powered transmitter through a central flowbore of a downhole component; transmitting a signal from a transmitting antenna disposed in the powered transmitter; generating an electric current in a receiver antenna disposed in the downhole component in response to receiving the signal from the transmitting antenna; and actuating an actuation system using the electric current. The downhole component may comprise a housing comprising the actuation system; and a sliding member slidably positioned within the housing. The sliding member may be configured to transition from a first position to a second position. When the sliding member is in the first position, the sliding member may prevent a route of fluid communication via one or more ports of the housing, and when the sliding member is in the second position, the sliding member may allow fluid communication via the one or more ports of the housing.

In an embodiment, a well screen assembly for use downhole comprises a fluid pathway configured to provide fluid communication between an exterior of a wellbore tubular and an interior of the wellbore tubular; a flow restrictor disposed in the fluid pathway; an actuation system comprising a receiving antenna, and a sliding member disposed in series with the flow restrictor in the fluid pathway. The receiving antenna is configured to generate an electric current in response to receiving a first electromagnetic signal having a first frequency, and the sliding member is transitional from a first position to a second position in response to the electric current. The sliding member prevents fluid communication along the fluid pathway when the sliding member is in the first position, and the sliding member allows fluid communication along the fluid pathway when the sliding member is in the second position.

In an embodiment, a well screen assembly for use in a wellbore comprises a plurality of fluid pathways. Each fluid pathway of the plurality of fluid pathways is configured to provide fluid communication between an exterior of a wellbore tubular and an interior of the wellbore tubular, and two or more fluid pathways of the plurality of fluid pathways comprise an actuation system comprising a receiving antenna, and a sliding member disposed in the corresponding fluid pathway. The receiving antenna is configured to generate an electric current in response to receiving a specific electromagnetic signal, and the sliding member is transitional from a first position to a second position in response to the electric current. The sliding member prevents fluid communication along the corresponding fluid pathway when the sliding member is in the first position, and the sliding member allows fluid communication along the corresponding fluid pathway when the sliding member is in the second position. The actuation systems in each of the two or more fluid pathways may be configured to generate the electric current in response to specific electromagnetic signals having different frequencies.

In an embodiment, a method comprises preventing, by a sliding member, fluid flow through a fluid pathway in a well screen assembly, inductively coupling, by a receiving antenna, with a transmitting antenna that is transmitting a first signal, generating an electric current in the receiving antenna in response to receiving the first signal, translating the sliding member using the electric current, and allowing fluid flow through the fluid pathway in response to the translating of the sliding member. The fluid pathway is configured to provide fluid communication between an exterior of a wellbore tubular and an interior of the wellbore tubular. A flow restrictor may be disposed in the fluid pathway.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
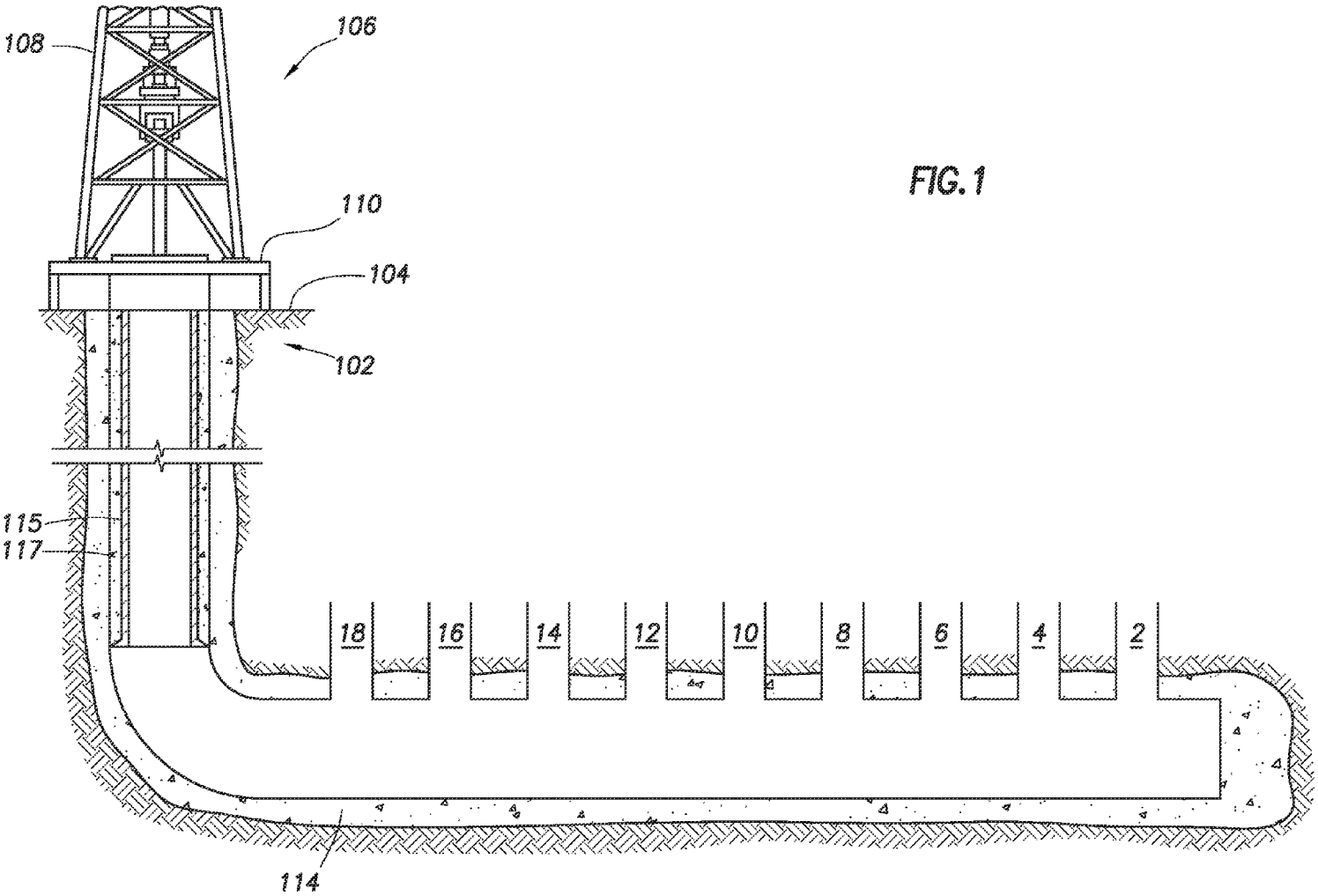
FIG. 1 is a partial cut-away of an embodiment of an environment in which an wireless activatable valve assembly and method of use of using such wireless activatable valve assembly may be employed.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "up-hole," or other like terms shall be construed as generally from the formation toward the surface or toward the surface of a body of water; likewise, use of "down," "lower," "downward," "down-hole," or other like terms shall be construed as generally into the formation away from the surface or away from the surface of a body of water, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The configuration of a wellbore may be varied throughout the life of the wellbore. This may allow for desired zones to be opened or closed to flow, or the flow characteristics adjusted during production. In order to implement this adjustment, a tool may be inserted into the wellbore to physically alter the configuration of the components of the drilling, completion, and/or production string. For example, a valve can be manually operated with a latch mechanism engaged to a slickline, coiled tubing, or the like, which requires a physical presence within the wellbore. Such operations may be expensive and difficult. As disclosed herein, a well tool such as a Wireless Activatable Valve Assembly (WAVA) may be used to adjust the configuration of the flowpaths within the wellbore. The WAVA may effect a change in the variation of a wellbore assembly using an electrical actuator coupling to a transmitter disposed within the wellbore. For example, the WAVA may rely on one or more batteries to supply power to actuation systems, receivers, actuators, and/or to any other components. Such embodiments may be used for a limited time corresponding to the life of the batteries.

In some embodiments, a power source such as a battery may not be present. Rather, the electrical actuator may be powered based on inductively coupling a receiving antenna with a transmitter disposed in the wellbore. When a receiver coupled to the actuator receives the proper frequency (e.g., a resonant frequency), an electrical current may be generated in the receiver that is sufficient to actuate the electrical actuator. In this embodiment, the electrical actuator may sit unpowered within the downhole assembly until needed. When it is desired to actuate the electrical actuator, a transmitter may be disposed in the wellbore that is configured to transmit the proper frequency to induce a current in the receiver. Since the receiver can be tuned to be sensitive to frequency, a transmitter may be capable of actuating only the desired electrical actuator while leaving other electrical actuator that are tuned to different frequencies unaffected. Thus, the wireless actuation tools disclosed herein, may allow for selective actuation of one or more flowpaths that may be disposed in a plurality of zones in the wellbore without the need to physically intervened in the wellbore other than disposing a transmitter into the wellbore. As such, the disclosed wireless actuation tools may provide an operator with improved control and flexibility for scheduling the actuation of various valves while offering an potential activation period that extends beyond the life of any batteries used with a well tool.

Disclosed herein are embodiments of a WAVA, as well as systems that may be utilized in performing the same. Particularly, disclosed herein are one or more embodiments of a WAVA configured for selective activation and methods of utilizing the same in servicing and/or completing a wellbore. In an embodiment, the WAVA and/or methods of utilizing the same, as disclosed herein, may allow an operator to wirelessly open and/or close one or more valves, such as for production of one or more zones of a subterranean formation and to produce a formation fluid therefrom.

Referring to FIG. 1, in an embodiment of an operating environment in which such a WAVA and/or method may be employed is illustrated. It is noted that although some of the figures may exemplify horizontal or vertical wellbores, the principles of the methods, apparatuses, and systems disclosed herein may be similarly applicable to horizontal wellbore configurations, conventional vertical wellbore configurations, or combinations thereof. Therefore, unless otherwise noted, the horizontal, deviated, or vertical nature of any figure is not to be construed as limiting the wellbore to any particular configuration.

Referring to the embodiment of FIG. 1, the operating environment generally comprises a wellbore 114 that penetrates a subterranean formation 102. Additionally, in an embodiment, the subterranean formation 102 may comprising a plurality of formation zones 2, 4, 6, 8, 10, 12, 14, 16, and 18 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig 106 comprises a derrick 108 with a rig floor 110 through which one or more tubular strings (e.g., a work string, a drill string, a tool string, a segmented tubing string, a jointed tubing string, or any other suitable conveyance, or combinations thereof) generally defining an axial flowbore may be positioned within or partially within the wellbore 114. In an embodiment, such a tubular string may comprise two or more concentrically positioned strings of pipe or tubing (e.g., a first work string may be positioned within a second work string). The drilling or servicing rig 106 may be conventional and may comprise a motor driven winch and other associated equipment for conveying the work string within the wellbore 114. Alternatively, a mobile workover rig, a wellbore servicing unit (e.g., coiled tubing units), or the like may be used to convey the tubular string within the wellbore 114. In such an embodiment, the tubular string may be utilized in drilling, stimulating, completing, or otherwise servicing the wellbore, or combinations thereof.

The wellbore 114 may extend substantially vertically away from the earth's surface over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved. In an embodiment, the wellbore 114 may be a new hole or an existing hole and may comprise an open hole, cased hole, cemented cased hole, pre-perforated lined hole, or any other suitable configuration, or combinations thereof. For example, in the embodiment of FIG. 1, a casing string 115 is positioned within at least a portion of the wellbore 114 and is secured into position with respect to the wellbore with cement 117 (e.g., a cement sheath). In alternative embodiments, portions and/or substantially all of such a wellbore may be cased and cemented, cased and uncemented, uncased, or combinations thereof. In another alternative embodiment, a casing string may be secured against the formation utilizing one or more suitable packers, such as mechanical packers or swellable packers (for example, SwellPackers™, commercially available from Halliburton Energy Services).

Figure 2:
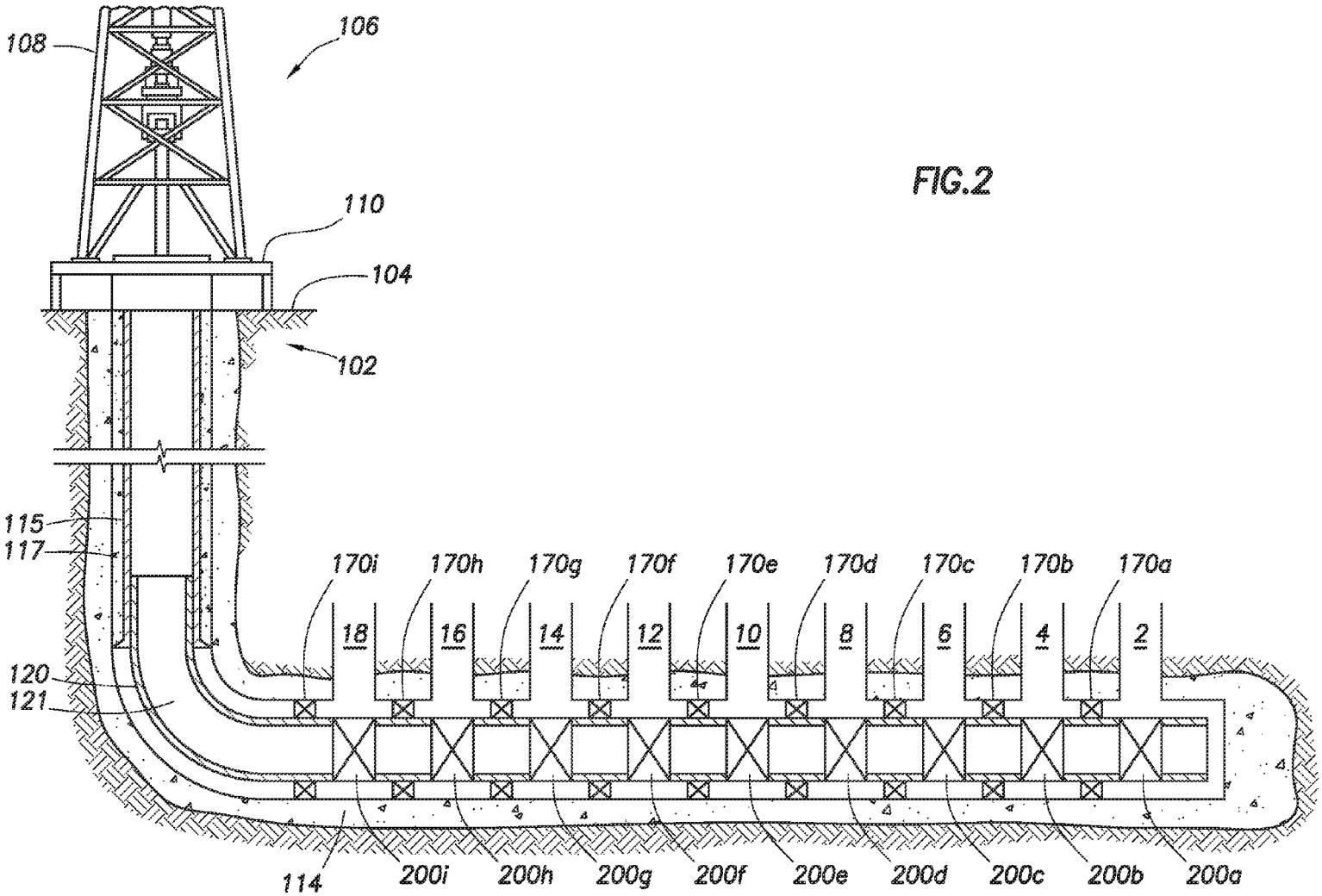
FIG. 2 is a partial cut-away view of an embodiment of a wellbore penetrating a subterranean formation, the wellbore having an wireless activatable valve assembly positioned therein.

In an embodiment as illustrated in FIG. 2, one or more WAVA 200 may be disposed within the wellbore 114. In such an embodiment, the wellbore tubular string 120 may comprise any suitable type and/or configuration of string, for example, as will be appreciated by one of skill in the art upon viewing this disclosure. In an embodiment, the wellbore tubular string 120 may comprise one or more tubular members (e.g., jointed pipe, coiled tubing, drill pipe, etc.). In an embodiment, each of the tubular members may comprise a suitable means of connection, for example, to other tubular members and/or to one or more WAVA 200, as disclosed herein. For example, in an embodiment, the terminal ends of the tubular members may comprise one or more internally or externally threaded surfaces, as may be suitably employed in making a threaded connection to other tubular members and/or to one or more WAVA 200. In an embodiment, the wellbore tubular string 120 may comprise a tubular string, a liner, a production string, a completion string, another suitable type of string, or combinations thereof.

In an embodiment, the WAVA 200 may be configured so as to selectively allow fluid flow there-through, for example, in response to receiving or sensing a predetermined EM signal. Referring to FIGS. 3A-3B and FIG. 6A-6C, an embodiment of such a WAVA 200 is disclosed herein. In the embodiment of FIGS. 3A-3B and FIG. 6A-6C, the WAVA 200 may generally comprise a housing 210 generally defining a flow passage 36, one or more sliding members 216, one or more ports 212 for fluid communication between the flow passage 36 of the WAVA 200 and an exterior of the WAVA 200 (e.g., an annular space), and a actuation system 226.

As used herein, the term "EM signal" refers to an electromagnetic signal. For example, an electrical signal may be transformed into an electromagnetic (EM) signal by exciting a proximate electric field and/or a proximate magnetic field, thereby generating an electromagnetic signal. Additionally, the EM signal may be transmittable via a transmitting antenna (e.g., an electrical conducting material, for example, a copper wire). Not intending to be bound by theory, the EM signal generally comprises an oscillating electrical field and an oscillating magnetic field propagating at a velocity proportional to or at about the speed of light. Additionally, the EM signal may be transmitted at a suitable magnitude of transmission power as would be appreciated by one of skill in the arts upon viewing this disclosure. Also, the EM signal may generally comprise polarized waves, non-polarized waves, longitudinal waves, transverse waves, and/or combinations thereof. The EM signal may be receivable and may be transformed into an electrical signal (e.g., an electrical current) via a receiving antenna (e.g., an electrical conducting material, for example, a copper wire), as disclosed herein.

In an embodiment, the EM signal may be characterized as comprising any suitable type or configuration of waveform or combination of waveforms, having any suitable characteristics or combinations of characteristics. For example, the EM signal may comprise one or more sinusoidal signals and/or one or more modulated analog signals, for example, via amplitude modulation, frequency modulation, phase modulation, quadrature amplitude modulation, space modulation, single-sideband modulation, the like, or combinations thereof. In an embodiment, the EM signal may exhibit any suitable duty-cycle, frequency, amplitude, phase, duration, or combinations thereof, as would be appreciated by one of skill in the art upon viewing this disclosure. For example, in an embodiment, the EM signal may comprise a sinusoidal waveform with a frequency within a frequency range of about 3 kHz to about 300 GHz, alternatively, about 100 kHz to about 10 GHz, alternatively, about 120 kHz to about 3 GHz, alternatively, about 120 kHz to about 920 MHz, alternatively, at any suitable frequency as would be appreciated by one of skill in the arts upon viewing this disclosure. Additionally or alternatively, in an embodiment the EM signal may comprise one or more modulated digital signals, for example, via amplitude-shift keying, continuous phase modulation, frequency-shift keying, multiple frequency-shift keying, minimum-shift keying, on-off keying, phase-shift keying, the like, or combinations thereof. For example, the EM signal may exhibit any suitable data rate, baud rate, and/or amplitude, as would be appreciated by one of skill in the art upon viewing this disclosure. For example, in an embodiment, the EM signal may comprises an on-off keying signal digital modulation at any suitable data rate.

In an embodiment, the WAVA 200 is selectively configurable either to disallow fluid communication to/from the flow passage 36 of the WAVA 200 to/from an exterior of the WAVA 200 or to allow fluid communication to/from the flow passage 36 of the WAVA 200 to/from an exterior of the WAVA 200. As illustrated in FIGS. 3A-3B and FIGS. 6A-6B, in an embodiment, the WAVA 200 may be configured to be transitioned from a first configuration to a second configuration, as disclosed herein.

Figure 3A:
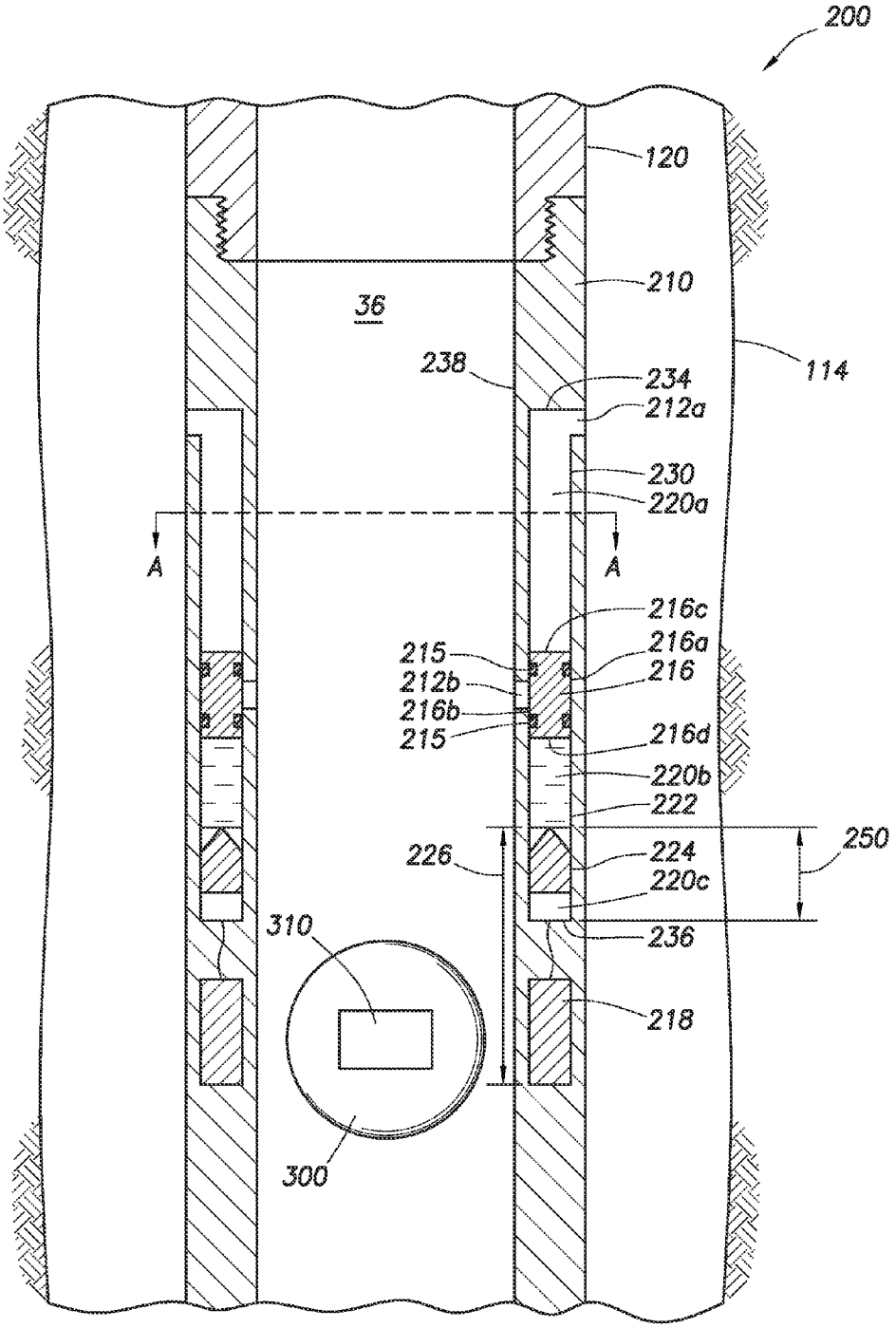
FIG. 3A is a cross-sectional view of an embodiment of a wireless activatable valve assembly in a first configuration.
Figure 6A:
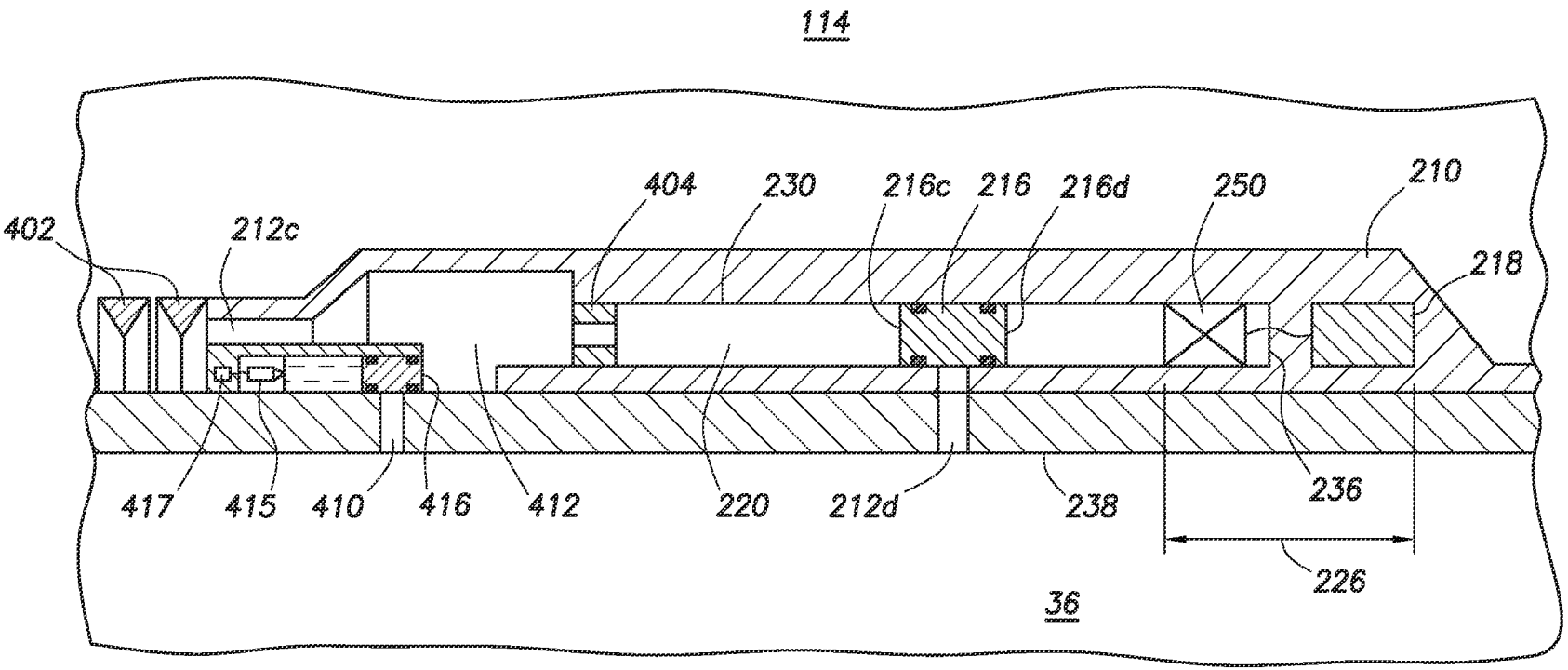
FIG. 6A is a cross-sectional view of an embodiment of a wireless activatable valve assembly comprising an inflow control device in a first configuration.

In the embodiment depicted by FIG. 3A and FIG. 6A, the WAVA 200 is illustrated in the first configuration. In the first configuration, the WAVA 200 is configured to disallow fluid communication between the flow passage 36 of the WAVA 200 and the wellbore 114 via the ports 212. Additionally, in an embodiment, when the WAVA 200 is in the first configuration, the sliding member 216 is located (e.g., immobilized) in a first position within the WAVA 200, as disclosed herein.

Figure 3B:
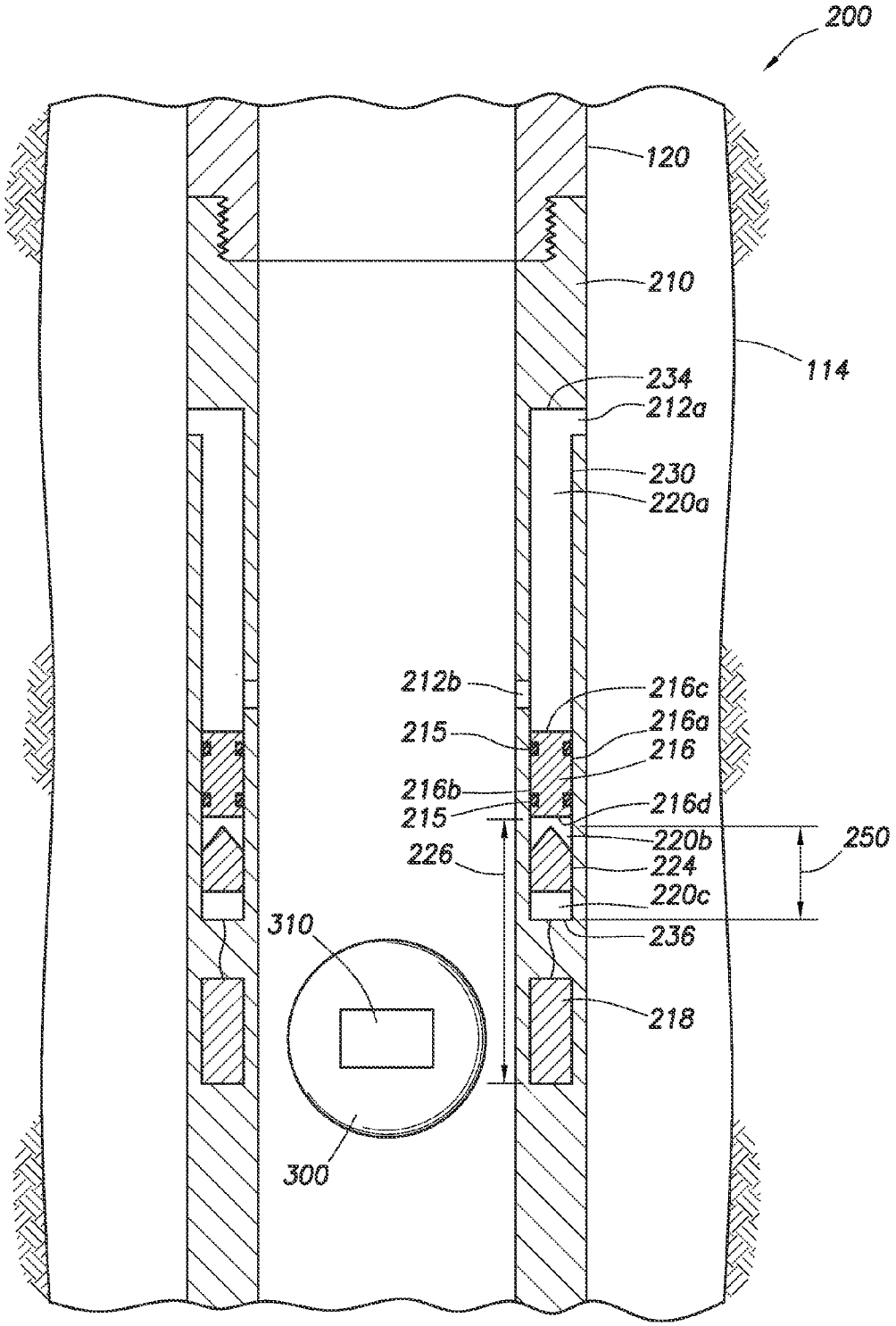
FIG. 3B is a cross-sectional view of an embodiment of a wireless activatable valve assembly in a second configuration.
Figure 6B:
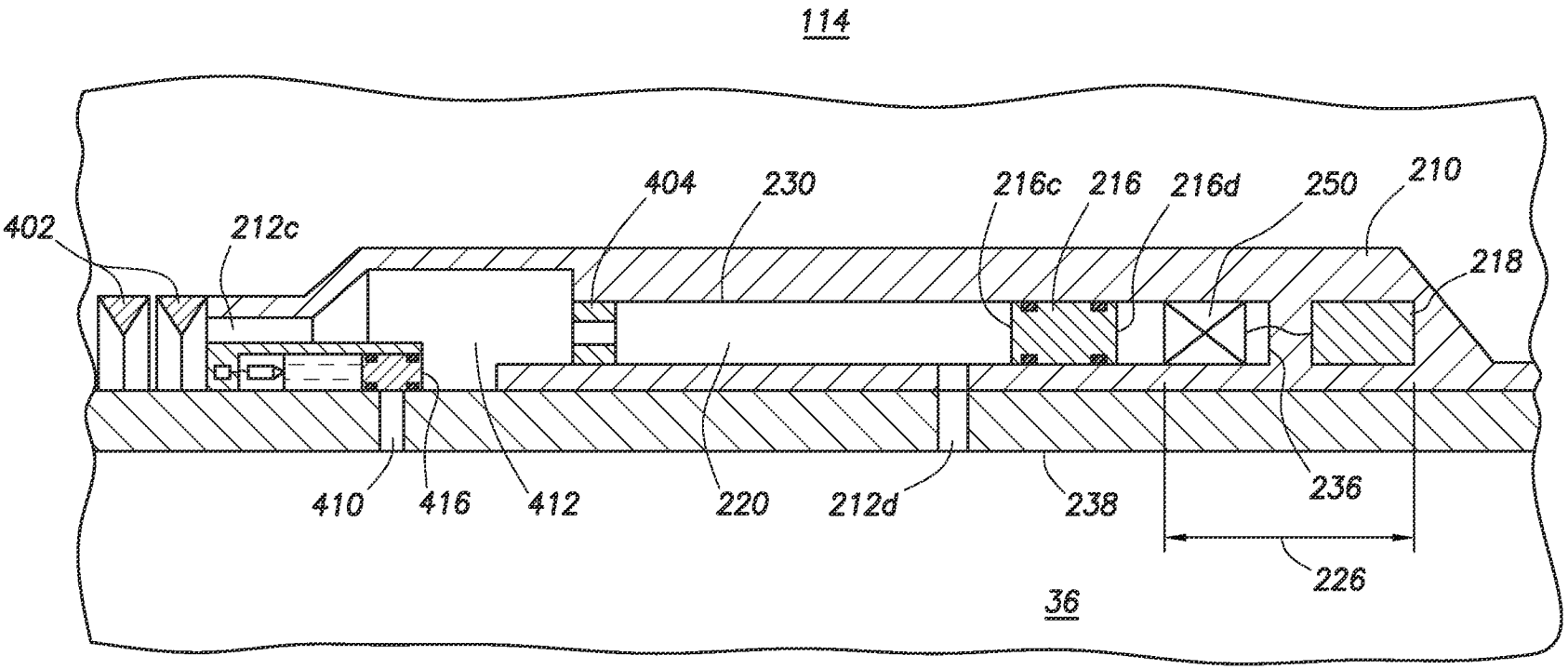
FIG. 6B is a cross-sectional view of an embodiment of a wireless activatable valve assembly comprising an inflow control device in a second configuration.

In an embodiment as depicted by FIG. 3B and FIG. 6B, the WAVA 200 is illustrated in the second configuration. In the second configuration, the WAVA 200 is configured to allow fluid communication between the flow passage 36 of the WAVA 200 and the wellbore 114 via one or more of the ports 212. In an embodiment, the WAVA 200 may be configured to transition from the first configuration to the second configuration upon the transmission of a predetermined signal (e.g., an EM signal) to the flow passage 36 of the WAVA 200, as disclosed herein. Additionally, in such an embodiment, when the WAVA 200 is in the second configuration one or more of the sliding members 216 is in the second position, as disclosed herein.

Figure 6C:
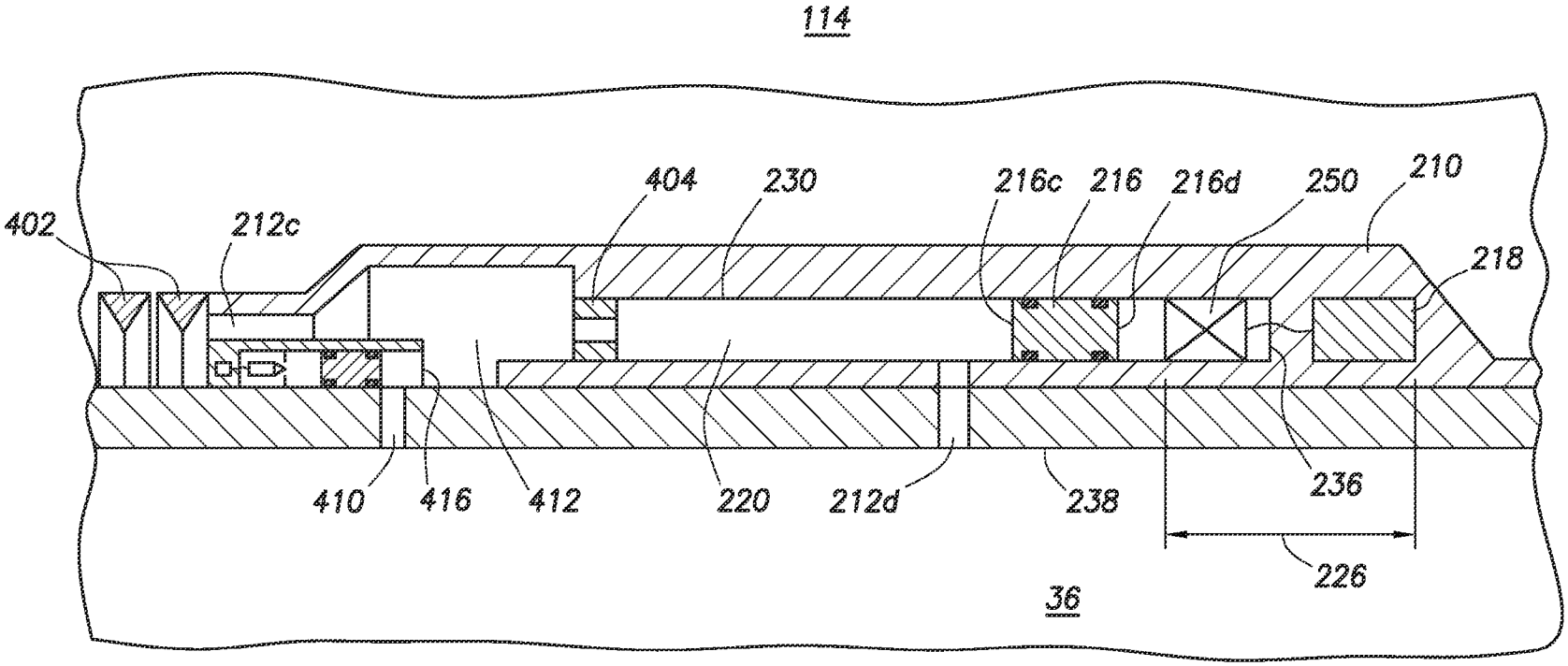
FIG. 6C is a cross-sectional view of an embodiment of a wireless activatable valve assembly comprising an inflow control device in a third configuration.

In an additional or alternative embodiment, as depicted in FIG. 6C, the WAVA 200 is illustrated in a third configuration. In the third configuration, the WAVA 200 is configured to allow fluid communication between the flow passage 36 of the WAVA 200 and the wellbore 114 via a bypass port 410, as disclosed herein. In an embodiment, the WAVA 200 may be configured to transition from the first position or the second configuration to the third configuration upon actuation of a bypass valve 416, as disclosed herein. Additionally, in such an embodiment, when the WAVA 200 is in the third configuration the sliding member 216 may be in either the first position or the second position, as disclosed herein.

Referring to FIGS. 3A-3B and FIGS. 6A-6C, in an embodiment, the WAVA 200 comprises a housing 210 which generally comprises a cylindrical or tubular-like structure. The housing 210 may comprise a unitary structure; alternatively, the housing 210 may be made up of two or more operably connected components (e.g., an upper component and a lower component). In an embodiment, the housing 210 may comprise any suitable structure; such suitable structures will be appreciated by those of skill in the art with the aid of this disclosure.

In an embodiment, the WAVA 200 may be configured for incorporation into the wellbore tubular string 120 or another suitable tubular string. In such an embodiment, the housing 210 may comprise a suitable connection to the wellbore tubular string 120 (e.g., to a casing string member, such as a casing joint), or alternatively, into any suitable string (e.g., a liner, a work string, a coiled tubing string, or other tubular string). For example, the housing 210 may comprise internally or externally threaded surfaces. Additional or alternative suitable connections to a casing string (e.g., a tubular string) will be known to those of skill in the art upon viewing this disclosure.

In the embodiment of FIGS. 3A-3B and FIGS. 6A-6C, the housing 210 generally defines the flow passage 36, for example, a flow path 36 generally defined by an inner bore surface 238 of the housing 210. In such an embodiment, the WAVA 200 is incorporated within the wellbore tubular string 120 such that the flow passage 36 of the WAVA 200 is in fluid communication with the flow passage 121 of the wellbore tubular string 120.

Figure 4:
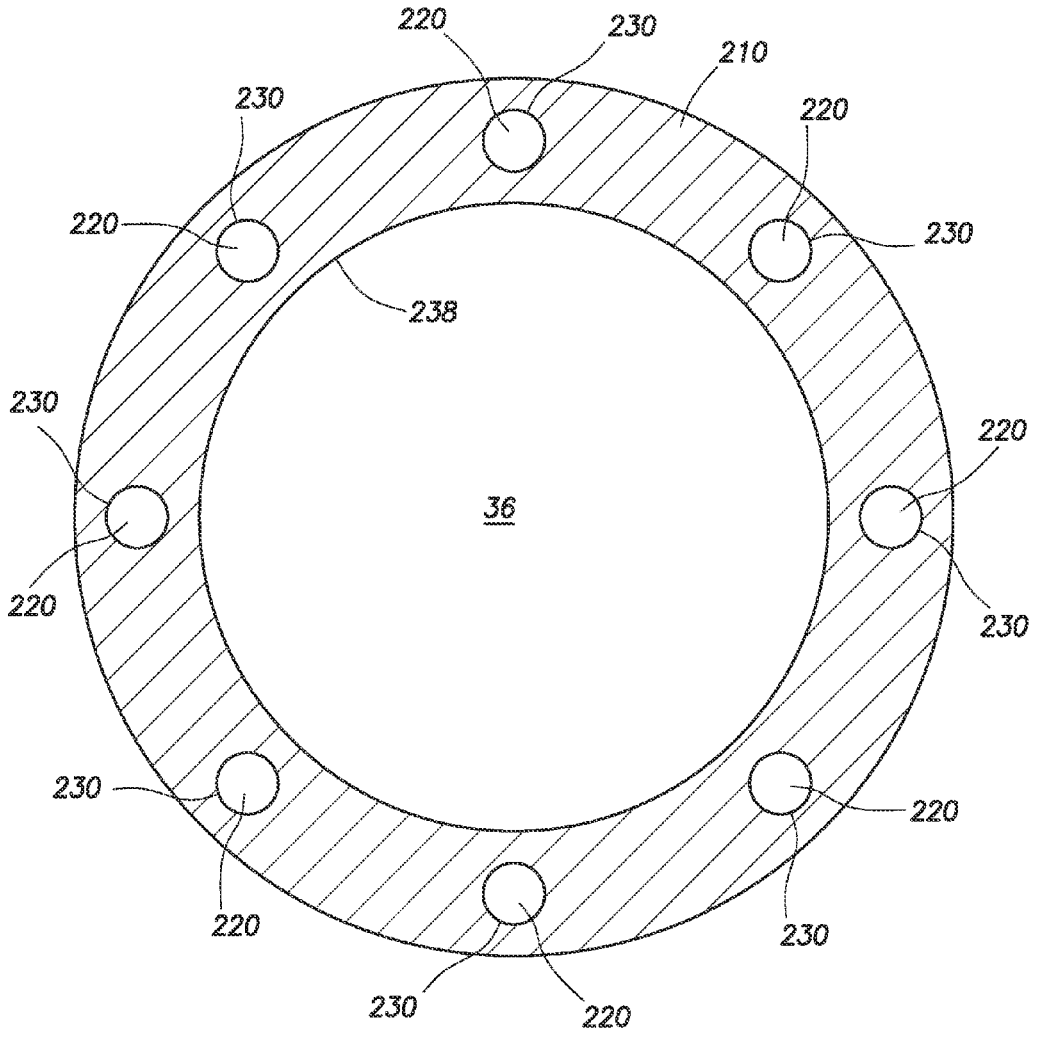
FIG. 4 is a partial cross-sectional view of an embodiment of a wireless activatable valve assembly along line A-A' of FIG. 3A.
Figure 5:
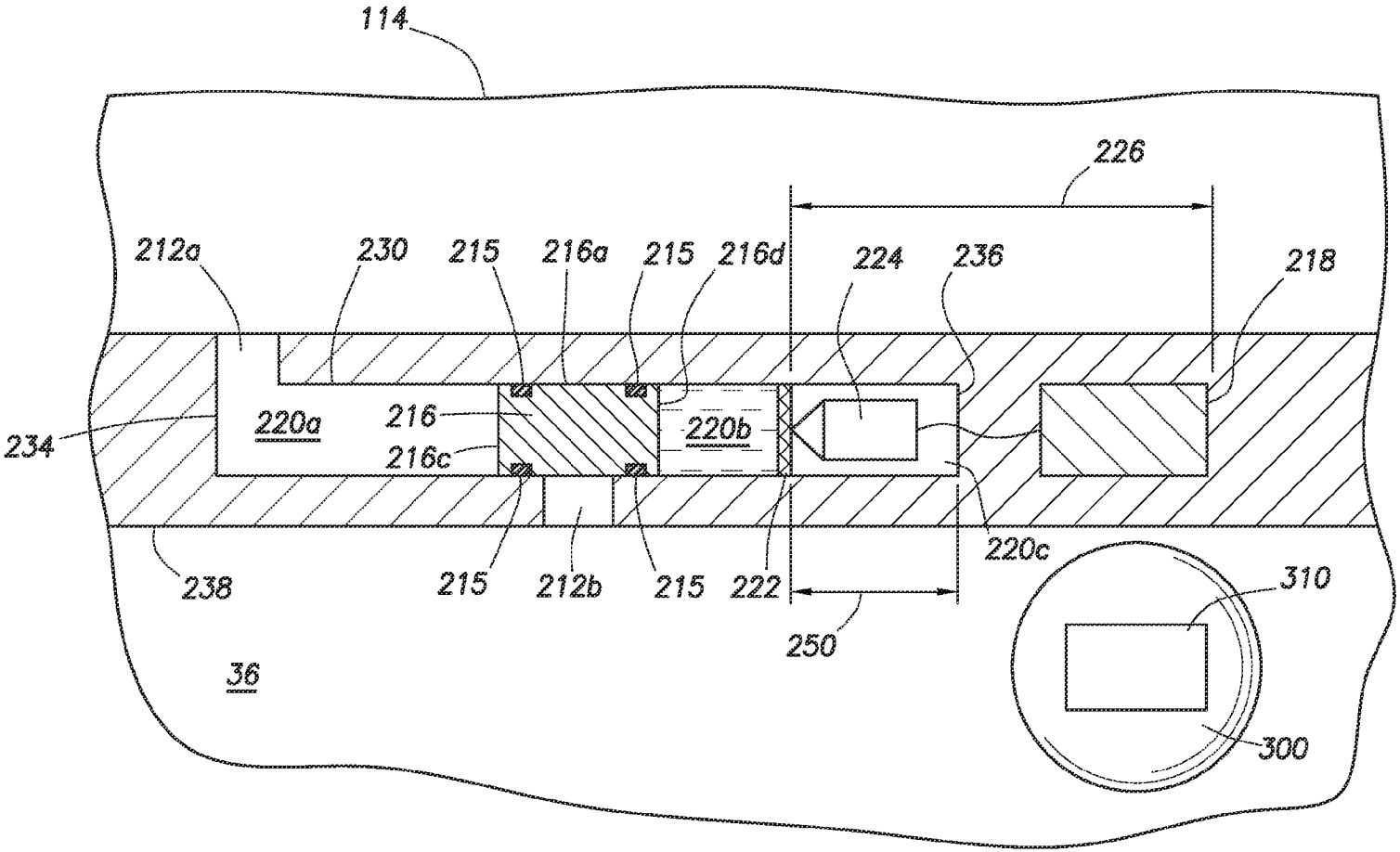
FIG. 5 is a partial cut-away view of an embodiment of a wireless activatable valve assembly.

In an embodiment, as illustrated in FIG. 4, the housing 210 may comprise one or more sliding chambers disposed circumferentially around the flow passage 36 of the housing 210 and the housing 210 may be configured to allow the one or more sliding members 216 to be slidably positioned therein. For example, in an embodiment, the housing 210 may generally define a sliding chamber 220. In an embodiment, as illustrated in FIG. 5, the sliding chamber 220 may generally comprise a cylindrical bore surface 230, a first axial face 234, and a second axial face 234. In an embodiment, the first axial face 234 may be positioned at an uphole interface of the cylindrical bore surface 230. Also in such an embodiment, the second axial face 234 may be positioned at a downhole interface of the cylindrical bore surface 230. While illustrated as cylindrical bores, sliding chambers comprising any suitable cross-section may be used with sliding members having corresponding cross-sections. In additional or alternative embodiments, the housing 210 may further comprise one or more recesses, cut-outs, chambers, voids, or the like in which one or more components of the actuation system 226 may be disposed, as disclosed herein.

In an embodiment, the housing 210 comprises one or more ports 212. In an embodiment, the one or more ports 212 may be disposed circumferentially around an interior and/or exterior surface of the housing 210. For example, the ports 212 may comprise an outer port orifice 212*a* and an inner port orifice 212*b* and may extend radially outward from and/or inwards towards the flow passage 36, as illustrated in FIG. 4. As such, these ports 212 may provide a route of fluid communication between the flow passage 36 and an exterior of the housing 210 when the WAVA 200 is so-configured. For example, the WAVA 200 may be configured such that the ports 212 provide a route of fluid communication between the flow passage 36 and the exterior of the WAVA 200 (for example, the annulus extending between the WAVA 200 and the walls of the wellbore 114 when the WAVA 200 is positioned within the wellbore) when the route of fluid communication of the ports 212 are unblocked (e.g., by the sliding member 216, as disclosed herein). Alternatively, the WAVA 200 may be configured such that no fluid will be communicated via the ports 212 between the flow passage 36 and the exterior of the WAVA 200 when the route of fluid communication of the ports are blocked (e.g., by the sliding member 216, as disclosed herein). When a plurality of WAVA are disposed in the sliding chambers disposed circumferentially around the flow passage of the housing 210, each WAVA may be configured to actuate in response to the same or a different frequency as any other WAVA, as described in more detail herein. This may allow for selective opening or reconfiguration of individual sliding chambers.

In an embodiment, as illustrated in FIGS. 3A-3B, the outer port orifice 212*a* may be disposed along the cylindrical bore surface 230 of the sliding chamber 220 and the outer port orifice 212*a* may provide a route of fluid communication between the exterior of the housing 210 and the sliding chamber 220. Additionally, the inner port orifice 212*b* may be disposed along the cylindrical surface 230 of the sliding chamber 220 and the inner port orifice 212*b* may provide a route of fluid communication between the sliding chamber 220 and the flow path 36 of the housing 210. In such an embodiment, the outer port orifice 212*a* may be substantially aligned, at least partially up-hole, or at least partially down-hole of the inner port orifice 212*b*.

In an alternative embodiment, as illustrated in FIGS. 6A-6C, the housing 210 may comprise an exterior port 212*c*, an interior port 212*d*, and a bypass port 410. In an embodiment, the external port 212*c* may provide a route of fluid communication between the exterior of the housing 210 and one or more chambers within the housing 210 (e.g., an inflow chamber 412), as disclosed herein. Additionally, the internal port 212*d* may be disposed along the cylindrical surface 230 of the sliding chamber 220 and the internal port 212*b* may provide a route of fluid communication between the sliding chamber 220 and the flow path 36 of the housing 210. Further, in an embodiment, the bypass port 410 may be disposed within the inflow chamber 412 of the housing 210 and may provide a route of fluid communication between the inflow chamber 412 and the flow path 36 of the housing 210.

In an additional embodiment, one or more of the ports 212 (e.g., the external port 212*c*) may be positioned adjacent to a plug, a screen, a filter, a "wire-wrapped" filter, a sintered mesh filter, a pre-pack filter, an expandable filter, a slotted filter, a perforated filter, a cover, or a shield, for example, to prevent debris from entering the ports 212. For example, in an embodiment as illustrated in FIG. 6A-6C, the WAVA 200 may comprise a filter 402 (e.g., a "wire-wrapped" filter) positioned adjacent to and/or covering the exterior port 212*c* and the filter 402 may be configured to allow a fluid to pass but not sand or other debris larger than a certain size. In an additional or alternative embodiment, the ports 212 may comprise one or more pressure-altering devices (e.g., nozzles, erodible nozzles, fluid jets, or the like).

In an additional or alternative embodiment, the housing 210 may comprise the inflow chamber 412. In the embodiments of FIG. 6A-6C, the inflow chamber 412 may provide a route of fluid communication between the exterior of the housing 210 and the flow passage 36 of the housing 210, for example, via the external port 212*c* and a flow restrictor 404 and/or the bypass port 410, when so configured, as disclosed herein.

In an embodiment, the flow restrictor 404 may be disposed within the housing 210 to provide a route of fluid communication between the inflow chamber 412 and the sliding chamber 220. In such an embodiment, the flow restrictor 404 may be configured to cause a fluid pressure differential across the flow restrictor 404 in response to flowing a fluid through the flow restrictor 404 in at least one direction. In an embodiment, the flow restrictor 404 may be cylindrical in shape and may comprise at least one fluid passage extending axially through the flow restrictor 404 having a diameter significantly smaller than the length of the passage. In an additional or alternative embodiment, the flow restrictor 404 may be formed of an orifice restrictor, a nozzle restrictor, a helical restrictor, a u-bend restrictor, and/or any other types of suitable restrictors for creating a pressure differential across the flow restrictor 404. In an additional or alternative embodiment, the flow restrictor 404 may permit one-way fluid communication, for example, allowing fluid communication in a first direction with minimal resistance and substantially preventing fluid communication in a second direction (e.g., providing a high resistance). For example, in an embodiment, the flow restrictor 404 may comprise a check-valve or other similar device for providing one-way fluid communication.

In an embodiment, the route of fluid communication provided by the flow restrictor 404 may be at least partially more restrictive (e.g., more resistance) than the route of fluid communication provided via the bypass port 410. For example, in an embodiment, a fluid may flow at a lower flow rate and/or with a higher pressure drop through the flow restrictor 404 than through the bypass port 410.

In an embodiment as shown in FIGS. 6A-6C, a bypass valve 416 may be disposed within the inflow chamber 412 and may be configured to selectively allow or disallow fluid communication between the inflow chamber 412 and flow passage 36 of the housing 210 via the bypass port 410, as disclosed herein. In an embodiment, the bypass valve 416 may comprise an actuatable valve, a sliding member, a rupture disk, or any other suitable device for selectively allowing or disallowing a route of fluid communication, as would be appreciated by one of skill in the art upon viewing this disclosure. For example, in an embodiment, the upon actuating (e.g., opening) the bypass valve 416 the WAVA 200 may be configured such that a fluid may be allowed to communicate between the inflow chamber 412 and the flow passage 36 of the housing 210 via the bypass port 410. In an embodiment, the bypass valve 416 comprises a sliding member 416, an actuator 415 and a receiver 417. The actuator 415 and or receiver 417 may be configured to be actuated in response to a different frequency and/or EM signal than the receiver 218. This may allow the actuator 250 to be actuated without activating the actuator 415, and vice versa.

In the embodiments of FIGS. 3A-3B and FIGS. 6A-6C, the sliding member 216 may be configured to selectively allow or disallow a route of fluid communication between the exterior of the housing 210 and the flow path 36 of the housing 210. In the embodiment of FIG. 5, the sliding member 216 generally comprises a cylindrical or tubular structure and may be sized to be slidably and concentrically fitted in a corresponding bore, as disclosed herein. In an embodiment, the sliding member 216 may comprise a unitary structure; alternatively, the sliding member 216 may be made up of two or more operably connected segments (e.g., a first segment, a second segment, etc.). Alternatively, the sliding member 216 may comprise any suitable structure. Such suitable structures will be appreciated by those of skill in the art upon viewing of this disclosure. In an embodiment, the sliding member 216 may comprise a cylindrical sliding member surface 216*a*, a first sliding member face 216*c*, and a second sliding member face 216*d*.

As shown in FIG. 5, the sliding member 216 may be slidably positioned within the housing 210 (e.g., within the sliding chamber 220). For example, in the embodiment of FIG. 5, at least a portion of the cylindrical sliding member surface 216*a* may be slidably fitted against at least a portion of cylindrical bore surface 230 of the housing 210 in a fluid-tight or substantially fluid-tight manner. In an embodiment, the sliding member 216 may further comprise one or more suitable seals (e.g., O-ring, T-seal, gasket, etc.) at one or more surface interfaces, for example, for the purposes of prohibiting or restricting fluid movement via such a surface interface. In the embodiment of FIG. 5, the sliding member 216 comprises seals 215 at the interface between the cylindrical sliding member surface 216*a* and the cylindrical bore surface 230.

In an embodiment, the sliding member 216 and the one or more seals 215 may be disposed within the sliding chamber 220 of the housing 210 such that at least an upper portion of the sliding chamber 220 (e.g., a first chamber portion 220*a*) may be fluidicly isolated from a lower portion of the sliding chamber 220 (e.g., a second chamber portion 220*b* and a third chamber portion 220*c*). In such an embodiment, the first chamber portion 220*a* may be generally defined by the first axial face 234, the first sliding member face 216*c*, and at least a portion of the cylindrical bore surface 230 extending between the first axial face 234 and the first sliding member face 216*c*. Additionally, in an embodiment, the second chamber portion 220*b* and the third chamber portion 220*c* may be in fluidic isolation from each other, for example, via an actuable member 222 (e.g., a rupture plate, an activatable valve), as disclosed herein. In such an embodiment, the second chamber portion 220*b* may be generally defined by the second sliding member face 216*d*, the actuable member 222, and at least a portion of the cylindrical bore surface 230 extending between the second sliding member face 216*d* and the actuable member 222. Also, in such an embodiment, the third chamber portion 220*c* may be generally defined by the actuable member 222, the second axial face 236, and at least a portion of the cylindrical bore surface 230 extending between the actuable member 222 and the second axial face 236.

In an embodiment, the first chamber portion 220*a*, the second chamber portion 220*b*, and/or the third chamber portion 220*c* may be characterized as having a variable volume. For example, the volume of the first chamber portion 220*a*, the second chamber portion 220*b*, and/or the third chamber portion 220*c* may vary with movement of the sliding member 216, as disclosed herein.

In an embodiment, the sliding member 216 may be movable, with respect to the housing 210, from a first position to a second position. In an embodiment, fluid communication between the flow passage 36 of the WAVA 200 and the exterior of the WAVA 200, for example, via the outer port orifice 212*a* and the inner port orifice 212*b* of the ports 212, may depend upon the position of the sliding member 216 relative to the housing 210.

Referring to the embodiments of FIG. 3A and FIG. 6A, the sliding member 216 is illustrated in the first position. For example, in an embodiment as illustrated in FIG. 3A, the sliding member 216 blocks the inner port orifice 212*b* of the housing 210 and thereby, prevents fluid communication between the flow passage 36 of the WAVA 200 the exterior of the WAVA 200 via the ports 212. In an alternative embodiment, in the first position the sliding member 216 may be positioned such that at least a portion of the sliding member 216 is between the outer port orifice 212*a* and the inner port orifice 212*b* and thereby blocks a route of route of fluid communication between the ports 212.

Referring to the embodiments of FIG. 3B and FIG. 6B, the sliding member 216 is illustrated in the second position. In the second position, such as illustrated in FIG. 3B, the sliding member 216 does not block the inner port orifice 212*b* of the housing 210 and thereby, allows fluid communication from the flow passage 36 of the WAVA 200 to the exterior of the WAVA 200 via the ports 212.

In an embodiment, the sliding member 216 may be held (e.g., selectively retained) in the first position by a suitable retaining mechanism, as disclosed herein. For example, in the embodiment of FIG. 3A, the sliding member 216 may be held (e.g., selectively retained) in the first position by a hydraulic fluid which may be selectively retained within the second chamber portion 220*b* by the actuation system 226 (e.g., to form a fluid lock). In such an embodiment, while the hydraulic fluid is retained within the second chamber portion 220*b*, the sliding member 216 may be impeded from moving in the direction of the second position. Conversely, while the hydraulic fluid is not retained within the second chamber portion 220*b*, the sliding member 216 may be allowed to move in the direction of the second position. In an embodiment, for example, in the embodiment illustrated by FIG. 3B, where fluid is not retained within the second chamber portion 220*b*, the sliding member 216 may be configured to transition from the first position to the second position upon the application of a pressure (e.g., hydraulic) to the first sliding member face 216*c*, as disclosed herein.

In an additional or alternative embodiment, the sliding member 216 may be held in the first position by one or more sheer pins. For example, one or more shear pins may extend between the housing 210 and the sliding member 216. In such an embodiment, the one or more shear pin may be inserted or positioned within a suitable borehole in the housing 210 and the borehole in the sliding member 216. As will be appreciated by one of skill in the art, the one or more shear pins may be sized to shear or break upon the application of a desired magnitude of force (e.g., force resulting from the application of a hydraulic fluid pressure, such as a pressure test) to the sliding member 216, as disclosed herein. In an alternative embodiment, the sliding member 216 may be held in the first position by any suitable frangible member, such as a shear ring or the like.

In an embodiment, the sliding member 216 may be configured to selectively transition from the first position to the second position. In an embodiment the sliding member 216 may be configured to transition from the first position to the second position following the activating of the actuation system 226. For example, upon activating the actuation system 226 a pressure change within the sliding chamber 220 may result in a differential force applied to the sliding member 216 in the direction towards the second position.

In such an embodiment, the sliding member 216 may comprise a differential in the surface area of the surfaces which are fluidicly exposed to the first chamber portion 220*a* (e.g., the second sliding member face 216*d*) and the surface area of the surfaces which are fluidicly exposed to the second chamber portion 220*b* and/or the third chamber portion 220*c* (e.g., the first sliding member face 216*c*). For example, in an embodiment, the exposed surface area of the surfaces of the sliding member 216 which will apply a force (e.g., a hydraulic force) in the direction toward the second position (e.g., a downward force) may be greater than exposed surface area of the surfaces of the sliding member 216 which will apply a force (e.g., a hydraulic force) in the direction away from the second position (e.g., an upward force). For example, in the embodiment of FIG. 3A and not intending to be bound by theory, the second chamber portion 220*b* is fluidicly sealed (e.g., by the one or more seals 115 and the actuable member 222), and therefore unexposed to hydraulic fluid pressures applied to the first chamber portion 220*a* thereby resulting in such a differential in the force applied to the sliding member 216 in the direction toward the second position (e.g., an downward force) and the force applied to the sliding member 216 in the direction away from the second position (e.g., an upward force). In an additional or alternative embodiment, a WAVA like WAVA 200 may further comprise one or more additional chambers (e.g., similar to first chamber portion 220*a*, the second chamber portion 220*b*, and/or the third chamber portion 220*c*) providing such a differential in the force applied to the first sliding member in the direction toward the second position and the force applied to the sliding member in the direction away from the second position. Alternatively, in an embodiment the sliding member 216 may be configured to move in the direction of the second position via a biasing member, such as a spring or compressed fluid or via a control line or signal line (e.g., a hydraulic control line/conduit) connected to the surface.

In an embodiment, the hydraulic fluid may comprise any suitable fluid. In an embodiment, the hydraulic fluid may be characterized as having a suitable rheology. In an embodiment, the second chamber portion 220*b* is filled or substantially filled with a hydraulic fluid that may be characterized as a compressible fluid, for example a fluid having a relatively low compressibility, alternatively, the hydraulic fluid may be characterized as substantially incompressible. In an embodiment, the hydraulic fluid may be characterized as having a suitable bulk modulus, for example, a relatively high bulk modulus. For example, in an embodiment, the hydraulic fluid may be characterized as having a bulk modulus in the range of from about 1.8 $10^5$ psi, $lb_f/in^2$ to about 2.8 $10^5$ psi, $lb_f/in^2$ from about 1.9 $10^5$ psi, $lb_f/in^2$ to about 2.6 $10^5$ psi, $lb_f/in^2$, alternatively, from about 2.0 $10^5$ psi, $lb_f/in^2$ to about 2.4 $10^5$ psi, $lb_f/in^2$. In an additional embodiment, the hydraulic fluid may be characterized as having a relatively low coefficient of thermal expansion. For example, in an embodiment, the hydraulic fluid may be characterized as having a coefficient of thermal expansion in the range of from about 0.0004 cc/cc/° C. to about 0.0015 cc/cc/° C., alternatively, from about 0.0006 cc/cc/° C. to about 0.0013 cc/cc/° C., alternatively, from about 0.0007 cc/cc/° C. to about 0.0011 cc/cc/° C. In another additional embodiment, the hydraulic fluid may be characterized as having a stable fluid viscosity across a relatively wide temperature range (e.g., a working range), for example, across a temperature range from about 50° F. to about 400° F., alternatively, from about 60° F. to about 350° F., alternatively, from about 70° F. to about 300° F. In another embodiment, the hydraulic fluid may be characterized as having a kinematic viscosity in the range of from about 50 centistokes to about 500 centistokes. Examples of a suitable hydraulic fluid include, but are not limited to oils, such as synthetic fluids, hydrocarbons, or combinations thereof. Particular examples of a suitable hydraulic fluid include silicon oil, paraffin oil, petroleum-based oils, brake fluid (glycol-ether-based fluids, mineral-based oils, and/or silicon-based fluids), transmission fluid, synthetic fluids, or combinations thereof.

In an embodiment, the actuation system 226 may be configured to transition the sliding member 216 from the first position to the second position. Additionally, in an embodiment, the actuation system 226 may be configured to selectively allow a route of fluid communication within the WAVA 200 upon receiving a predetermined EM signal, as disclosed in more detail herein. For example, in an embodiment the actuation system 226 may allow a route of communication between two or more chambers 220 of the WAVA 200 upon receiving a predetermined EM signal, for example, a transmitter 300 transmitting an RF signal of about a predetermined frequency within the flow passage 36 of the WAVA 200. Additionally, in an embodiment, the actuation system 226 may be configured to selectively respond to one or more predetermined characteristics of an EM signal (e.g., frequency, modulation), as disclosed herein.

In an embodiment, the actuation system 226 generally comprises a receiver 218 and an actuator 250, as illustrated in FIG. 5. In an embodiment, the receiver 218 and/or the actuator 250 may be fully or partially incorporated within the WAVA 200 by any suitable means as would be appreciated by one of skill in the art. For example, in an embodiment, the receiver 218 and/or the actuator 250 may be housed, individually or separately, within a recess within the housing 210 of the WAVA 200. In an alternative embodiment, as will be appreciated by one of skill in the art, at least a portion of the receiver 218 and/or the actuator 250 may be otherwise positioned, for example, external to the housing 210 of the WAVA 200. It is noted that the scope of this disclosure is not limited to any particular configuration, position, and/or number of the receivers 218, and/or actuators 250. For example, although the embodiment of FIG. 5 illustrates an actuation system 226 comprising multiple distributed components (e.g., a single receiver 218 and a single actuator 250, each of which comprises a separate, distinct component), in an alternative embodiment, a similar actuation system may comprise similar components in a single, unitary component; alternatively, the functions performed by these components (e.g., the receiver 218 and the actuator 250) may be distributed across any suitable number and/or configuration of like componentry, as will be appreciated by one of skill in the art with the aid of this disclosure.

In an embodiment, the receiver 218 may comprise a receiving antenna and may be generally configured to receive a signal (e.g., an EM signal). The receiver 218 may output an activation signal (e.g., an analog voltage or current), which may be generated due to receiving the EM signal, upon a determination that the receiving antenna has experienced the predetermined EM signal. For example, in an embodiment, the receiver 218 may output an activation signal (e.g., an electrical current) to the actuator 250 in response to receiving a predetermined EM signal (e.g., an RF signal of about a predetermined frequency).

In an embodiment, the receiver 218 may comprise one or more receiving antennas. In an embodiment, the receiving antenna may be positioned within the housing 210 of the WAVA 200 such that the receiving antenna may sense EM signals within the flow passage 36 of the housing 210. In order to allow the EM signal to be detected by a receiving antenna, a window of material configured to allow for the transmission of an EM signal may be disposed in the housing adjacent or near the receiving antenna. In such an embodiment, the one or more receiving antennas may be configured to receive a signal (e.g., the EM signal) and may convert the EM signal to a suitable electrical signal (e.g., an electrical current). In an alternative embodiment, the one or more receiving antennas may be configured to inductively couple with a transmitting antenna and in response may output a suitable electrical signal (e.g., an electrical current). For example, in an embodiment, a suitable electrical signal may comprise a varying voltage signal or a varying current signal indicative of the predetermined EM signal. In an embodiment, the receiving antenna may be configurable and/or tunable to resonate and/or to respond selectively to an EM signal comprising one or more predetermined frequencies. The receiving antenna may comprise a receiver circuit, or be tuned based on the design of the receiving antenna (e.g., based on the coil length, diameter, etc.). For example, in an embodiment, the receiver may comprise a coiled receiving antenna and in response to receiving an EM signal of about a predetermined frequency the coiled receiving antenna may inductively generate an EM field which may be transferred into an electrical current or an electrical voltage (e.g., via inductive coupling) above a threshold value. In an embodiment, EM signals varying from the predetermined frequencies by more than a certain amount (e.g., by more than about 5%, more than about 10%, more than about 15%, or more than about 20%) may not produce an inductive coupling, and/or may not generate an electrical current or voltage above the threshold value necessary to actuate the WAVA.

In an embodiment, the receiving antenna may generally comprise an electrically conductive material such as one or more materials formed of aluminum, copper, gold, and/or any other suitable conductive material, as would be appreciated by one of skill in the art upon viewing this disclosure. In an embodiment, the one or more materials of the receiving antenna may form a coiled antenna, a loop antenna, short dipole antenna, a half-wave dipole antenna, a double zepp antenna, an extended double zepp antenna, a one and one half wave dipole antenna, a dual dipole antenna, an off center dipole antenna, a microstrip antenna, a patch antenna, a stripline antenna, a PCB transmission line antenna, and/or any other suitable type of antenna as would be appreciated by one of skill in the art upon viewing this disclosure. Additionally, in an embodiment, the receiving antenna may comprise a terminal interface. In such an embodiment, the terminal interface may electrically and/or physically connect the receiving antenna to a receiving circuit, as disclosed herein. In an embodiment, the terminal interface may comprise one or more wire leads, one or more metal traces, a BNC connector, a terminal connector, an optical connector, and/or any other suitable connection interfaces as would be appreciated by one of skill in the arts upon viewing this disclosure.

In an embodiment, the receiver 218 may further comprise an optional receiving circuit and may be configured to tune the receiving antenna and/or respond to the presence of the predetermined EM signal from the receiving antenna. For example, the receiving circuit may be configured to set and/or to adjust the resonance of the receiving antenna and to output an electrical signal (e.g., an analog voltage, an analog current) in response to receiving the predetermined EM signal. Additionally or alternatively, the receiving circuit may be configure to amplify the electrical signal from the receiving antenna, to filter the electrical signal from the receiving antenna, to trigger the actuator 250, and/or any combination thereof, as would be appreciated by one of skill in the art upon viewing this disclosure. In such an embodiment, the receiving circuit may be in signal communication with the receiving antenna. In an embodiment, the receiving circuit receives an electrical signal from the receiving antenna and generates an output response (e.g., an electrical current or an electrical voltage). In an embodiment, the receiving circuit may comprise any suitable configuration, for example, comprising one or more printed circuit boards, one or more integrated circuits (e.g., an ASIC), a one or more discrete circuit, one or more active devices, one or more passive devices components (e.g., a resistor, an inductor, a capacitor), one or more microprocessors, one or more microcontrollers, one or more wires, an electromechanical interface, a power supply and/or any combination thereof. For example, the receiving circuit may comprise a resistor-inductor-capacitor circuit and may configure the receiving antenna to resonate and/or to respond to a predetermined frequency. As noted above, the receiving circuit may comprise a single, unitary, or non-distributed component capable of performing the function disclosed herein; alternatively, the receiving circuit may comprise a plurality of distributed components capable of performing the functions disclosed herein.

In an embodiment (for example, in the embodiment of FIG. 4 where the receiver 218 and the actuator 250 comprise distributed components) the receiver 218 may communicate with the actuator 250 via a suitable signal conduit, for example, via one or more suitable wires. Examples of suitable wires include, but are not limited to, insulated solid core copper wires, insulated stranded copper wires, unshielded twisted pairs, fiber optic cables, coaxial cables, any other suitable wires as would be appreciated by one of skill in the art, or combinations thereof.

In an embodiment, the receiving circuit may comprise a voltage driving circuit (e.g., a transistor power amplifier) configured to output a voltage signal (e.g., an activation signal) to the actuator 250 in response to the electrical current or electrical voltage from the receiving antenna. In an alternative embodiment, the receiving circuit may comprise a switch (e.g., an electromechanical relay, a one or more transistor, one or more digital logic gates) configured to short a physical connection between the actuator 250 and an electronic voltage supply in response to the electrical current or electrical voltage from the receiving antenna.

In an embodiment, the receiving circuit may communicate with the actuator 250 via a suitable signaling protocol. Examples of such a signaling protocol include, but are not limited to, an encoded digital signal. Alternatively, in an embodiment, the receiving circuit may communicate with the actuator 250 via an electronic signal (e.g., an analog voltage or current signal).

In an embodiment, the receiving circuit may be configured to output a digital voltage or a current signal to an actuator 250 in response to the presence of the predetermined EM signal. For example, in an embodiment, the receiving circuit may be configured to transition its output from a low voltage signal (e.g., about 0V) to a high voltage signal (e.g., about, 1.5 V, about 3 V, about 5 V) in response to the presence of the predetermined RF signal. In an alternative embodiment, the receiving circuit may be configured to transition its output from a high voltage signal (e.g., about, 1.5 V, about 3 V, about 5 V) to a low voltage signal (e.g., about 0V) in response to the presence of the predetermined EM signal.

Additionally, in an embodiment, the receiving circuit may be configured to operate in either a low-power consumption or "sleep" mode or, alternatively, in an operational or active mode. The receiving circuit may be configured to enter the active mode (e.g., to "wake") in response to a predetermined RF signal, for example, as disclosed herein. In some embodiments, the actuator 250 may not be coupled to a power source other than the power generated by the receiving antenna.

In an embodiment, the receiver 218 may be supplied with electrical power generated by the receiving antenna. For example, in an embodiment, in response to receiving an EM signal the receiving antenna (e.g., a coiled antenna) may inductively generate an EM field, which may be transferred into an electrical current or an electrical voltage (e.g., inductive coupling). For example, in an embodiment, the EM field may generate an alternating electrical current and the receiver 218 may comprise a bridge rectifier configured generate an electrical voltage in response to the alternating electrical current passing there-through. In such an embodiment, the electrical voltage generated by the bridge rectifier may power the receiver 218 and/or the actuator 250. For example, the generated power may supply power in the range of from about 3 mW to about 0.5 W, alternatively, from about 0.5 to about 1.0 W. In an embodiment, the power generated by the antenna may be the only power available to the device, which may be sufficient to actuate the actuator 250. In an embodiment, the power supplied by the receiving antenna may be the only source of power for the receiver 218 and/or actuator 250.

In an alternative embodiment, the receiver 218 may receive electrical power via a power source. For example, in such an embodiment, the WAVA 200 may further comprise an on-board battery, be coupled to a power generation device, be coupled to a power source within the wellbore, be coupled to a power source outside the wellbore, or any combination thereof. In such an embodiment, the power source and/or power generation device may supply power to the receiver circuit 218, to the actuator 250, and/or combinations thereof, for example, for the purpose of operating the receiver 218, the actuator, or combinations thereof. An example of a power source and/or a power generation device is a Galvanic Cell. In an embodiment, the power source and/or power generation device may be sufficient to power the receiver 218, the actuator 250, or combinations thereof. For example, the power source and/or power generation device may supply power in the range of from about 0.5 to about 10 watts, alternatively, from about 0.5 to about 1.0 watt.

In an embodiment, the actuator 250 may generally be configured to provide selective fluid communication in response to an activation signal (e.g., an analog voltage or current). For example, the actuator 250 may allow or disallow a fluid to be communicated between two or more chambers 220 in response to an activation signal. In an embodiment, at least a portion of the actuator 250 may be positioned adjacent to and/or partially define the third chamber portion 220*c*. In such an embodiment, the actuator 250 may be configured to provide fluid communication between the third chamber portion 220*c* and the second chamber portion 220*b* in response to an activation signal. In an embodiment, the third chamber portion 220*c* may have a pressure below that of the second chamber portion 220*b*.

In an embodiment as illustrated in FIG. 5, the actuator 250 may comprise a piercing member 224 such as a punch or needle. In such an embodiment, the punch may be configured, when activated, to puncture, perforate, rupture, pierce, destroy, disintegrate, combust, or otherwise cause the actuable member 222 to cease to seal the third chamber portion 220*c*. In such an embodiment, the punch may be electrically driven, for example, via an electrically-driven motor or an electromagnet. Alternatively, the punch may be propelled or driven via a hydraulic means, a mechanical means (such as a spring or threaded rod), a chemical reaction, an explosion, or any other suitable means of propulsion, in response to receipt of an activating signal. Suitable types and/or configuration of actuators 250 are described in U.S. Patent Pub. No. 2011/0174504 entitled "Well Tools Operable Via Thermal Expansion Resulting from Reactive Materials" to Adam D. Wright, et al., and U.S. Patent Pub. No. 2010/0175867 entitled "Well Tools Incorporating Valves Operable by Low Electrical Power Input" to Wright et al., the entire disclosures of which are incorporated herein by reference. In an alternative embodiment, the actuator may be configured to cause combustion of the actuable member. For example, the actuable member may comprise a combustible material (e.g., thermite) that, when detonated or ignited may burn a hole in the actuable member 222. In an embodiment, the actuator 250 (e.g., the piercing member 224) may comprise a flow path (e.g., ported, slotted, surface channels, etc.) to allow hydraulic fluid to pass therethrough.

In an alternative embodiment, the actuator 250 may comprise an activatable valve. In such an embodiment, the valve may be integrated within the housing 210, for example, at least partially defining the sliding chamber 220 (e.g., defining the third chamber 220*c*). In such an embodiment, the valve may be activated (e.g., opened) so as to allow fluid communication between the third chamber portion 220*c* and the second chamber portion 220*b*.

In an embodiment, the actuable member 222 may be configured to contain the hydraulic fluid within the second chamber portion 220*b* until a triggering event occurs (e.g., an activation signal), as disclosed herein. For example, in an embodiment, the actuable member 222 may be configured to be punctured, perforated, ruptured, pierced, destroyed, disintegrated, combusted, or the like, for example, when subjected to a desired force or pressure. In an embodiment, the actuable member 222 may comprise a rupture disk, a rupture plate, or the like, which may be formed from a suitable material. Examples of such a suitable material may include, but are not limited to, a metal, a ceramic, a glass, a plastic, a composite, or combinations thereof.

In an embodiment, upon destruction of the actuable member 222 (e.g., open), the hydraulic fluid within the second chamber portion 220*b* may be free to move out of the second chamber portion 220*b* via the pathway previously contained/obstructed by the actuable member 222. For example, in the embodiment of FIG. 3B, upon destruction of the actuable member 222, the third chamber portion 220*c* may be configured such that the fluid may be free to flow out of the second chamber portion 220*b* and into the third chamber portion 220*c*. In alternative embodiments, the third chamber portion 220*c* may be configured such that the fluid flows into a secondary chamber (e.g., an expansion chamber), out of the well tool (e.g., into the wellbore), into the flow passage, or combinations thereof.

Additionally or alternatively, the second chamber portion 220*b* may be configured to allow the fluid to flow therefrom at a predetermined or controlled rate. For example, in such an embodiment, an atmospheric chamber may further comprise a fluid meter, a fluidic diode, a fluidic restrictor, or the like. For example, in such an embodiment, the fluid may be emitted from the second chamber portion 220*b* via a fluid aperture, for example, a fluid aperture which may comprise or be fitted with a fluid pressure and/or fluid flow-rate altering device, such as a nozzle or a metering device such as a fluidic diode. In an embodiment, such a fluid aperture may be sized to allow a given flow-rate of fluid, and thereby provide a desired opening time or delay associated with flow of fluid exiting the second chamber portion 220*b* and, as such, the movement of the sliding member 216. Fluid flow-rate control devices and methods of utilizing the same are disclosed in U.S. Patent Application Pub. No. 2011/0036590 entitled "System and Method for Servicing a Wellbore" to Jimmie R. Williamson, et al., which is incorporated herein by reference in its entirety.

In an embodiment, such an EM signal may be generated by a transmitter formed as or contained within a tool, or other apparatus (e.g., a ball, a dart, a bullet, a plug, etc.) disposed within the wellbore tubular string 120. For example, in the embodiments of FIGS. 3A-3B, the transmitter 300 (e.g., a dart) may transmit a predetermined EM signal and may be disposed within the flow passage 121 of the wellbore tubular string 120 and/or the flow passage of the WAVA 200 so as to be detected by the WAVA or a component thereof, as disclosed herein. In an embodiment, the transmitter 300 may comprise a transmitting circuit 310.

In an embodiment, the transmitter 300 may comprise one or more transmitting antennas. In an embodiment, the transmitting antenna may be positioned within the transmitter 300 such that the transmitting antenna may transmit EM signals within the flow passage 36 of the housing 210 of the WAVA 200. In such an embodiment, the one or more transmitting antennas may be configured to transmit an electrical signal (e.g., an electrical current) and may convert the electrical signal to a suitable EM signal. In an additional or alternative embodiment, the one or more transmitting antennas may be configured to inductively couple with a receiving antenna. In an embodiment, the transmitting antenna may be configured by the transmitting circuit 310 to transmit an EM signal comprising one or more predetermined frequencies. For example, the transmitting antenna may only transmit an EM signal of a predetermined frequency, or a plurality of EM signals of predetermined frequencies.

In an embodiment, the transmitting antenna may generally comprise a conductive material such as one or more materials formed of aluminum, copper, gold, and/or any other suitable conductive material, as would be appreciated by one of skill in the art upon viewing this disclosure. In an embodiment, the one or more materials of the transmitting antenna may form a coiled antenna, a loop antenna, short dipole antenna, a half-wave dipole antenna, a double zepp antenna, an extended double zepp antenna, a one and one half wave dipole antenna, a dual dipole antenna, an off center dipole antenna, a microstrip antenna, a patch antenna, a stripline antenna, a PCB transmission line antenna, and/or any other suitable type of antenna as would be appreciated by one of skill in the art upon viewing this disclosure. Additionally, in an embodiment, the transmitting antenna may comprise a terminal interface. In such an embodiment, the terminal interface may electrically and/or physically connect the receiving antenna to the transmitting circuit 310. In an embodiment, the terminal interface may comprise one or more wire leads, one or more metal traces, a BNC connector, a terminal connector, an optical connector, and/or any other suitable connection interfaces as would be appreciated by one of skill in the arts upon viewing this disclosure.

In an embodiment, the transmitting circuit 310 may be configured to generate an EM signal and to transmit the EM signal via the transmitting antenna. For example, in an embodiment, the transmitting circuit 310 may generally be configured to generate an electrical signal (e.g., an electrical current or electrical voltage), to amplify the electrical signal, to modulate the electrical signal, to filter the electrical signal, to transmit the electrical signal via the transmitting antenna and/or any combination thereof, as would be appreciated by one of skill in the art upon viewing this disclosure. In such an embodiment, the transmitting circuit 310 may be in signal communication with the transmitting antenna.

In an embodiment, the transmitting circuit 310 may comprise any suitable configuration, for example, comprising one or more printed circuit boards, one or more integrated circuits (e.g., an ASIC), a one or more discrete circuit components, one or more active devices, one or more passive devices (e.g., a resistor, an inductor, a capacitor), one or more microprocessors, one or more microcontrollers, one or more wires, an electromechanical interface, a power supply and/or any combination thereof. As noted above, the transmitting circuit 310 may comprise a single, unitary, or non-distributed component capable of performing the function disclosed herein; alternatively, the transmitting circuit 310 may comprise a plurality of distributed components capable of performing the functions disclosed herein.

For example, in an embodiment, the transmitting circuit 310 may comprise an integrated circuit comprising a crystal oscillator and a coiled transmitting antenna. In such an embodiment, the crystal oscillator may be configured to generate an electrical voltage signal comprising one or more predetermined frequencies. Additionally, in such an embodiment, the electrical voltage signal maybe applied to the coiled transmitting antenna and in response the coiled transmitting antenna may generate an EM signal. As disclosed herein, the EM signal may be effective to elicit a response from the WAVA, such as to "wake" one or more components of the actuation system 226, to activate the actuation system 226 as disclosed herein, or combinations thereof.

In an embodiment, the transmitting circuit 310 may be supplied with electrical power via a power source. For example, in such an embodiment, the transmitter 300 may comprise an on-board battery, a power generation device, or combinations thereof. In such an embodiment, the power source and/or power generation device (e.g., a battery) may supply power to the transmitting circuit 310, for example, for the purpose of operating the transmitting circuit 310. An example of a power source and/or a power generation device is a Galvanic Cell. In an embodiment, the power source and/or power generation device may be sufficient to power the transmitting circuit 310. For example, the power source and/or power generation device may supply power in the range of from about 0.5 to about 10 watts, alternatively, from about 0.5 to about 1.0 watt.

One or more embodiment of a WAVA 200 and a system comprising one or more of such WAVA 200 having been disclosed, one or more embodiments of a wireless actuation system method utilizing the one or more WAVAs 200 (and/or system comprising such WAVA 200) is disclosed herein. In an embodiment, such a method may generally comprise the steps of providing a wellbore tubular string 120 comprising one or more WAVAs 200 within a wellbore 114 that penetrates the subterranean formation 102, optionally, isolating adjacent zones of the subterranean formation, passing a transmitter 300 within the flow passage 121 of the wellbore tubular string 120, preparing the WAVA 200 for communication of a formation fluid (for example, a hydrocarbon, such as oil and/or gas), and communicating a formation fluid via the ports 212 of the WAVA 200. In an additional embodiment, for example, where multiple WAVA 200 are placed within a wellbore 114, a downhole component actuation method may further comprise repeating the process of preparing the WAVA 200 for the communication of a production fluid and communicating a production fluid via the ports 212 if the WAVA 200 for each of the WAVA 200.

Referring to FIG. 2, in an embodiment the wireless actuation system method comprises positioning or "running in" a completion string 120 comprising a plurality of WAVA 200*a*-200*i* within the wellbore 114. For example, in the embodiment of FIG. 2, the completion string 120 has incorporated therein a first WAVA 200*a*, a second WAVA 200*b*, a third WAVA 200*c*, a fourth WAVA 200*d*, a fifth WAVA 200*e*, a sixth WAVA 200*f*, a seventh WAVA 200*g*, an eighth WAVA 200*h*, and a ninth WAVA 200*i*. Also in the embodiment of FIG. 2, the completion string 120 is positioned within the wellbore 114 such that the first WAVA 200*a*, the second WAVA 200*b*, the third WAVA 200*c*, the fourth WAVA 200*d*, the fifth WAVA 200*e*, the sixth WAVA 200*f*, the seventh WAVA 200*g*, the eighth WAVA 200*h*, and the ninth WAVA 200*i* may be positioned proximate and/or substantially adjacent to a first, a second, a third, a fourth, a fifth, a sixth, a seventh, an eighth, and a ninth subterranean formation zone 2, 4, 6, 8, 10, 12, 14, 16, and 18, respectively. It is noted that although in the embodiment of FIG. 2, the wellbore tubular string 120 comprises nine WAVAs (e.g., WAVA 200*a*-200*i*), one of ordinary skill in the art, upon viewing this disclosure, will appreciate that any suitable number of WAVA 200 may be similarly incorporated within a tubular string such as the wellbore tubular string 120, for example one, two, three, four, five, six, seven, eight, or more WAVA 200. In an alternative embodiment, two or more WAVA 200 may be positioned proximate and/or substantially adjacent to a single formation zone, alternatively, a WAVA 200 may be positioned adjacent to two or more zones.

In an embodiment, once the completion string 120 comprising the WAVA 200 (e.g., WAVA 200*Za*-200*i*) has been positioned within the wellbore 114, one or more of the adjacent zones may be isolated and/or the completion string 120 may be secured within the formation 102. For example, in an embodiment, the first zone 2 may be isolated from relatively more uphole portions of the wellbore 114 (e.g., via a first packer 170*a*), the first zone 2 may be isolated from the second zone 4 (e.g., via a second packer 170*b*), the second zone 4 from the third zone 6 (e.g., via a third packer 170*c*), the third zone 6 from the fourth zone 4 (e.g., via a fourth packer 170*d*), the fourth zone 8 from relatively more downhole portions of the wellbore 114 (e.g., via a fifth packer 170*e*), or combinations thereof. In an embodiment, the adjacent zones may be separated by one or more suitable wellbore isolation devices. Suitable wellbore isolation devices are generally known to those of skill in the art and include but are not limited to packers, such as mechanical packers and swellable packers (e.g., Swellpackers™, commercially available from Halliburton Energy Services, Inc.), sand plugs, sealant compositions such as cement, or combinations thereof. In an alternative embodiment, only a portion of the zones (e.g., 2-18) may be isolated, alternatively, the zones may remain unisolated. Additionally and/or alternatively, a casing string may be secured within the formation, as noted above, for example, by cementing.

In an embodiment, for example, as shown in FIG. 2, the WAVA 200*a*-200*i* may be integrated within the completion string 120, for example, such that, the WAVA 200 and the completion string 120 comprise a common flow passage. Thus, a fluid and/or an object introduced into the completion string 120 will be communicated with the WAVA 200.

In the embodiment, the WAVA 200 is introduced and/or positioned within a wellbore 114 in the first configuration, for example as shown in FIG. 3A and FIG. 6A. As disclosed herein, in the first configuration, the sliding member 216 may be held in the first position, thereby blocking fluid communication to/from the flow passage 36 of the WAVA 200 to/from the exterior of the WAVA 200 via the ports 212. In some embodiments, the sliding member 216 may be positioned in a bypass port and a separate flow passage may exist to allow production through a flow control device. The first configuration of the completion assembly comprising the WAVA in the first position may be used during a completion operation and/or during production for any amount of time.

In an embodiment where the wellbore is serviced working from the furthest-downhole formation zone progressively upward, the first WAVA 200*a* may be to be transitioned into a different configuration. For example, the WAVA 200*a* may be prepared for the communication of a formation fluid (for example, a hydrocarbon, such as oil and/or gas) from the proximate formation zone(s). In an embodiment, preparing the WAVA 200 to communicate the formation fluid may generally comprise communicating an EM signal within the flow passage 36 of the WAVA 200 to transition the WAVA 200 from the first configuration to the second configuration.

In an embodiment, the EM signal may be communicated to the WAVA 200 to transition the WAVA 200 from the first configuration to the second configuration, for example, by transitioning the sliding member 216 from the first position to the second position. In an embodiment, the EM signal may be transmitted by introducing a transmitter (e.g., a dart) to the flow passage 36 of the completion string 120. In an embodiment, the EM signal may be unique to one or more WAVAs 200 and/or one or more receivers 218 of the one or more WAVAs 200. For example, a WAVA 200 (e.g., the actuation system 226 of such a well tool) may be configured such that a predetermined EM signal may elicit a given response from that particular well tool and/or WAVA. For example, the EM signal may be characterized as unique to a particular tool (e.g., one or more of the WAVA 200*a*-200*i* and/or one or more receivers 218). In an additional or alternative embodiment, a given EM signal may cause a given tool to enter an active mode (e.g., to wake from a low power consumption mode) and/or to activate the actuation system 226.

In an embodiment, the EM signal may comprise known characteristics, known frequencies, modulations, data rates, for example, as previously disclosed. The EM signal may be sensed by the receiving antenna of one or more receivers 218. In an embodiment, the receiving antenna may communicate with the actuator 250, for example, by transmitting an analog voltage signal via electrical wires in response to detecting a predetermined EM signal (e.g., a known frequency, modulation, and/or any other characteristics of the EM signal).

In an embodiment, in response to (e.g., upon) receiving the predetermined EM signal, the actuation system 226 may allow fluid to escape from the second chamber portion 220*b*. For example, in an embodiment, the receiver 218 may detect an EM signal within the flow passage 36 and the receiver 218 may determine whether the EM signal experienced is a predetermined EM signal (e.g., via an inductive coupling). In response to the predetermined EM signal, the receiver 218 may communicate an activation signal (e.g., an electrical current) to the actuator 250, thereby causing the actuator 250 to cease to seal the second chamber portion 200*b* and to provide fluid communication with the fluid contained therein. As fluid flows from the second chamber portion 220*b*, the fluid will no longer retain the sliding member 216 in its first position and the sliding member 216 may transition from the first position to the second position. For example, the sliding member 216 may transition from the first position to the second position as a result of a fluid pressure applied to the first chamber portion 220*a*. In an embodiment, the sliding member 216 may move from the first position to the second position because of a differential in the surface area of the upward-facing surfaces which are fluidicly exposed to the first chamber portion 220*a* and the surface area of the downward-facing surfaces which are fluidicly exposed to the second chamber portion 220*b*. In an embodiment, the transition of the sliding member 216 from the first position to the second position may open the WAVA to flow by unblocking the inner port orifice 212*b*, thereby providing a route of fluid communication between the inner port orifice 212*b* and the outer port orifice 212*a* to fluid flow. In an embodiment, the transition of the sliding member 216 from the first position to the second position may open a flowpath through a flow restriction by unblocking the interior port 212*d*, thereby providing a route of fluid communication between the external port 212*c* and the interior port 212*d* to fluid flow. In an embodiment, the process of preparing the WAVA 200 for the communication of a fluid may further comprise actuating (e.g., opening) one or more bypass valves 416 of the WAVA 200. In such an embodiment, the one or more bypass valve 416 of the WAVA 200 may be actuated (e.g., via an electrical current) and may provide a route of fluid communication between the exterior port 212*c* and the flow passage 36 via the bypass port 410. Once the WAVA 200 has been configured for the communication of a formation fluid (e.g., a hydrocarbon, such as oil and/or gas), for example, when the well tool (e.g., the first WAVA 200*a*) has transitioned to the second configuration, fluid communication may be established between the first formation zone 2 and the flow passage 36 via the unblocked ports 212 of the first WAVA 200*a*.

In an embodiment, the process of preparing the WAVA 200 for the communication of a fluid (e.g., a production fluid) via communication of a EM signal, and communicating a production fluid via the ports 212 of the WAVA 200 to the zone proximate to that WAVA 200 may be repeated with respect to one or more of the well tools (e.g., the first WAVA 200*a*, the second WAVA 200*b*, the third WAVA 200*c*, the fourth WAVA 200*d*, the fifth WAVA 200*e*, the sixth WAVA 200*f*, the seventh WAVA 200*g*, the eighth WAVA 200*h*, and/or the ninth WAVA 200*i*). For example, in an embodiment, the process of preparing the WAVA may be repeated for the first WAVA 200*a* and may actuate (e.g., open) one or more additional ports 212 for fluid communication. In an additional or alternative embodiment, one or more WAVAs 200 (e.g., the second WAVA 200*b*) may be prepared for communication of a fluid (e.g., a production fluid).

When one or more of the well tools are present in the wellbore, the transmitter may be used to actuate only a single WAVA or a plurality of the WAVA. For example, the transmitter may transmit a single frequency that inductively couples with a specific WAVA (e.g., the first WAVA 200*a*), thereby providing power to actuate the specific WAVA. In order to actuate another WAVA, a second transmitter may be disposed in the wellbore to actuate one or more of the remaining WAVA (e.g., the second WAVA 200*b*, the third WAVA 200*c*, the fourth WAVA 200*d*, the fifth WAVA 200*e*, the sixth WAVA 200*f*, the seventh WAVA 200*g*, the eighth WAVA 200*h*, and/or the ninth WAVA 200*i*). This process may be repeated to actuate the desired number of WAVA. In an embodiment, the single frequency transmitted by the transmitter may actuate a plurality of WAVA. For example, two or more of the WAVA may be configured to actuate based on the same frequency EM signal. In this embodiment, a transmitter may be used to actuate the applicable plurality of WAVA in a single pass along the wellbore.

In an embodiment, a transmitter may transmit a plurality of frequencies, which may actuate a plurality of WAVA. For example, the transmitter may transmit a plurality of frequencies, with each frequency being inductively coupled to one or more of the WAVA (e.g., one or more of the first WAVA 200*a*, the second WAVA 200*b*, the third WAVA 200*c*, the fourth WAVA 200*d*, the fifth WAVA 200*e*, the sixth WAVA 200*f*, the seventh WAVA 200*g*, the eighth WAVA 200*h*, or the ninth WAVA 200*i*). The receivers associated with each WAVA may be configured to inductively couple with one of the plurality of frequencies, thereby allowing for any desired combination of WAVA to be actuated by a transmitter passed through the wellbore. As another example, when a plurality of WAVA are present in a single location (e.g., distributed circumferentially around a sleeve), the transmitter may be configured to actuate one or more of the WAVA, without necessarily actuating all of the WAVA. This may allow for a selective configuration of the flowpath at a given location.

In some embodiments, the transmitter may transmit different frequencies at different times and/or locations within the wellbore. In this embodiment, the transmitter may transmit one or more frequencies as it passes through the wellbore. The transmitter may vary the transmission of the one or more frequencies based on time, depth, pressure, temperature, or the like to selectively actuate one or more of the WAVA. The ability of the transmitter to transmit a single signal, a plurality of signals, or signals that change during passage through the wellbore may allow for the WAVA to be selectively reconfigured during use, with some zones being changed, while others are left in the original or subsequent configurations.

Having described the systems and method herein, various embodiments may include, but are not limited to:

In an embodiment, a wireless actuation system comprises a transmitter, an actuation system comprising a receiving antenna, and one or more sliding members transitional from a first position to a second position. The transmitter is configured to transmit an electromagnetic signal, and the sliding member prevents a route of fluid communication via one or more ports of a housing when the sliding member is in the first position. The sliding member allows fluid communication via the one or more ports of the housing when the sliding member is in the second position, and the actuation system is configured to allow the sliding member to transition from the first position to the second position in response to recognition of the electromagnetic signal by the receiving antenna. The receiving antenna may be tuned to receive a specific signal frequency, and the actuation system may be configured to allow the sliding member to transition from the first position to the second position in response to the receiving antenna receiving the specific signal frequency. The actuation system may be configured to maintain the sliding member in the first position in response to the receiving antenna receiving a signal substantially different than the specific signal frequency. The transmitter may comprise a power source and a signal generator coupled to a transmitting antenna. The receiving antenna may be configured to generate an electrical current in response to receiving the electromagnetic signal from the transmitter. The actuation system may be configured to allow the sliding member to transition from the first position to the second position responsive to the electrical current. The actuation system may comprise an actuator coupled to the receiving antenna, and the actuator may be configured to transition the sliding member from the first position to the second position. The actuator may comprise a piercing member and an actuable member. The actuator may comprise an actuatable valve. The actuation system may be configured to pierce, rupture, destroy, perforate, disintegrate, or combust the actuable member in response to the recognition of the predetermined electromagnetic signal by the receiving antenna. The wireless actuation system may comprise a fluid chamber disposed between the one or more sliding members and the actuation system, and the fluid chamber may be configured to retain the one or more sliding members in the first position when fluid is sealed in the fluid chamber. The actuation system may be configured to selectively allow fluid to escape from the fluid chamber in response to recognition of the predetermined electromagnetic signal by the receiving antenna.

In an embodiment, a wireless actuation system comprises a receiving antenna, an actuation mechanism coupled to the receiving antenna, a pressure chamber, and a slidable component disposed in a downhole tool. The receiving antenna is configured to generate an electric current in response to receiving a signal, and the actuation mechanism is configured to selectively trigger fluid communication between the pressure chamber and the slidable component using the electric current. The slidable component is configured to transition from a first position to a second position based on a pressure differential between the pressure chamber and a second pressure source. The receiving antenna may be tuned to generate the electric current in response to receiving the signal. The slidable component may prevent a route of fluid communication via one or more ports of a housing when the slidable component is in the first position, and the slidable component may allow fluid communication via the one or more ports of the housing when the slidable component is in the second position. The pressure chamber may comprise an atmospheric chamber. The wireless actuation system may also include a valve, and the actuation mechanism may be configured to open the valve using the electric current to provide the fluid communication between the pressure chamber and the slidable component.

In an embodiment, an actuation system for a downhole component comprises a powered transmitter comprising a transmitting antenna, and a downhole component comprising a central flowbore and a receiving antenna coupled to an actuation system. The powered transmitter is configured to be received within the central flowbore, and the transmitting antenna is configured to transmit a signal. The receiving antenna is configured to generate an electric current in response to receiving the signal from the transmitting antenna, and the actuation system is configured to actuate using the electric current from the receiving antenna. The signal may be configured to selectively generate the electric current in the receiver antenna. The actuation system may be configured to puncture a rupture disk, and the actuation system may be configured to actuate a valve from an open position to a closed position or from a closed position to an open position in response to puncturing the rupture disk. The powered transmitter may comprise a power source and a signal generator coupled to the transmitting antenna. The actuation system may also include a valve member, and the actuation system may be configured to actuate the valve member in response to receiving the electrical current from the receiving antenna.

In an embodiment, a method of actuating a downhole component comprises passing a powered transmitter through a central flowbore of a downhole component; transmitting a signal from a transmitting antenna disposed in the powered transmitter; generating an electric current in a receiver antenna disposed in the downhole component in response to receiving the signal from the transmitting antenna; and actuating an actuation system using the electric current. The downhole component may comprise a housing comprising the actuation system; and a sliding member slidably positioned within the housing. The sliding member may be configured to transition from a first position to a second position. When the sliding member is in the first position, the sliding member may prevent a route of fluid communication via one or more ports of the housing, and when the sliding member is in the second position, the sliding member may allow fluid communication via the one or more ports of the housing. The method may also include transitioning the sliding member from the first position to the second position in response to the actuating of the actuation system. The signal may be uniquely associated with the receiver antenna. The transmitter may comprise a transmitting antenna configured to transmit the signal, and the electric current may be generated through inductive coupling between the transmitting antenna and the receiving antenna.

In an embodiment, a well screen assembly for use downhole comprises a fluid pathway configured to provide fluid communication between an exterior of a wellbore tubular and an interior of the wellbore tubular; a flow restrictor disposed in the fluid pathway; an actuation system comprising a receiving antenna, and a sliding member disposed in series with the flow restrictor in the fluid pathway. The receiving antenna is configured to generate an electric current in response to receiving a first electromagnetic signal having a first frequency, and the sliding member is transitional from a first position to a second position in response to the electric current. The sliding member prevents fluid communication along the fluid pathway when the sliding member is in the first position, and the sliding member allows fluid communication along the fluid pathway when the sliding member is in the second position. The well screen assembly may also include a second actuation system comprising a second receiving antenna, and a second sliding member disposed in parallel with the flow restrictor. The second receiving antenna may be configured to generate an electric current in response to receiving a second electromagnetic signal having a second frequency, and the second sliding member may be disposed in a second fluid pathway between the exterior of the wellbore tubular and the interior of the wellbore tubular. The second fluid pathway may bypass the flow restrictor, and the second sliding member may prevent fluid communication along the second fluid pathway when the second sliding member is in an initial position. The second sliding member may allow fluid communication along the second fluid pathway when the second sliding member is in an actuated position. The first frequency and the second frequency may be the same, or the first frequency and the second frequency may be different. The well screen assembly may also include a transmitter, and the transmitter may be configured to transmit the first electromagnetic signal to the receiving antenna. The transmitter may further be configured to transmit the second electromagnetic signal to the second receiving antenna. The well screen assembly may also include a second transmitter, and the second transmitter may be configured to transmit the second electromagnetic signal to the second receiving antenna. The well screen assembly may also include a second fluid pathway configured to provide fluid communication between an exterior of a second wellbore tubular and an interior of the second wellbore tubular, a second flow restrictor disposed in the second fluid pathway, a second actuation system comprising a second receiving antenna, and a second sliding member disposed in series with the second flow restrictor in the second fluid pathway. The wellbore tubular and the second wellbore tubular may form parts of a wellbore tubular string. The second receiving antenna may be configured to generate a second electric current in response to receiving a second electromagnetic signal having a second frequency, and the second sliding member may be transitional from a third position to a fourth position in response to the second electric current. The second sliding member may prevent fluid communication along the second fluid pathway when the second sliding member is in the third position, and the second sliding member may allow fluid communication along the second fluid pathway when the second sliding member is in the fourth position. The first frequency and the second frequency may be different.

In an embodiment, a well screen assembly for use in a wellbore comprises a plurality of fluid pathways. Each fluid pathway of the plurality of fluid pathways is configured to provide fluid communication between an exterior of a wellbore tubular and an interior of the wellbore tubular, and two or more fluid pathways of the plurality of fluid pathways comprise an actuation system comprising a receiving antenna, and a sliding member disposed in the corresponding fluid pathway. The receiving antenna is configured to generate an electric current in response to receiving a specific electromagnetic signal, and the sliding member is transitional from a first position to a second position in response to the electric current. The sliding member prevents fluid communication along the corresponding fluid pathway when the sliding member is in the first position, and the sliding member allows fluid communication along the corresponding fluid pathway when the sliding member is in the second position. The actuation systems in each of the two or more fluid pathways may be configured to generate the electric current in response to specific electromagnetic signals having different frequencies. The well screen assembly may also include a flow restriction disposed in at least one of the two or more fluid pathways. The receiving antenna may be physically tuned to the specific electromagnetic signal. The well screen assembly may also include a transmitter, and the transmitter may be configured to transmit the specific electromagnetic signal to at least one corresponding receiving antenna. At least one receiving antenna may be configured to not generate an electric current in response to the transmitter transmitting the specific electromagnetic signal to the at least one corresponding receiving antenna.

In an embodiment, a method comprises preventing, by a sliding member, fluid flow through a fluid pathway in a well screen assembly, inductively coupling, by a receiving antenna, with a transmitting antenna that is transmitting a first signal, generating an electric current in the receiving antenna in response to receiving the first signal, translating the sliding member using the electric current, and allowing fluid flow through the fluid pathway in response to the translating of the sliding member. The fluid pathway is configured to provide fluid communication between an exterior of a wellbore tubular and an interior of the wellbore tubular. A flow restrictor may be disposed in the fluid pathway. The method may also comprise preventing, by a second sliding member, fluid flow through a second fluid pathway in the well screen assembly, inductively coupling, by a second receiving antenna, with a second transmitting antenna that is transmitting a second signal; generating a second electric current in the second receiving antenna in response to receiving the second signal; translating the second sliding member using the second electric current; and allowing fluid flow through the second fluid pathway in response to the translating of the second sliding member. The second fluid pathway may be configured to provide fluid communication between the exterior of a wellbore tubular and an interior of the wellbore tubular. The second fluid pathway may be disposed in parallel with the fluid pathway. The transmitting antenna and the second transmitting antenna may be disposed in the same transmitter. The first signal and the second signal may have approximately the same frequencies, or the first signal and the second signal may have different frequencies.

It should be understood that the various embodiments previously described may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=R1+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A well screen assembly for use downhole comprising:

a first fluid pathway configured to provide fluid communication between an exterior of a wellbore tubular and an interior of the wellbore tubular;

a flow restrictor disposed in the fluid pathway;

a first actuation system comprising a first receiving antenna, wherein the first receiving antenna is configured to generate an electric current in response to receiving a first electromagnetic signal having a first frequency; and a first sliding member disposed in series with the flow restrictor in the fluid pathway, wherein the sliding member is transitional from a first position to a second position in response to the electric current; wherein the sliding member prevents fluid communication along the fluid pathway when the sliding member is in the first position, and wherein the sliding member allows fluid communication along the fluid pathway when the sliding member is in the second position.

2. The well screen assembly of claim 1, further comprising:

a second actuation system comprising a second receiving antenna, wherein the second receiving antenna is configured to generate an electric current in response to receiving a second electromagnetic signal having a second frequency; and a second sliding member disposed in parallel with the flow restrictor, wherein the second sliding member is disposed in a second fluid pathway between the exterior of the wellbore tubular and the interior of the wellbore tubular, wherein the second fluid pathway bypasses the flow restrictor, and wherein the second sliding member prevents fluid communication along the second fluid pathway when the second sliding member is in an initial position, wherein the second sliding member allows fluid communication along the second fluid pathway when the second sliding member is in an actuated position.

3. The well screen assembly of claim 2, wherein the first frequency and the second frequency are the same.

4. The well screen assembly of claim 2, wherein the first frequency and the second frequency are different.

5. The well screen assembly of claim 2, further comprising a transmitter, wherein the transmitter is configured to transmit the first electromagnetic signal to the first receiving antenna.

6. The well screen assembly of claim 5, wherein the transmitter is further configured to transmit the second electromagnetic signal to the second receiving antenna.

7. The well screen assembly of claim 5, further comprising a second transmitter, wherein the second transmitter is configured to transmit the second electromagnetic signal to the second receiving antenna.

8. The well screen assembly of claim 1, further comprising:

a second fluid pathway configured to provide fluid communication between an exterior of a second wellbore tubular and an interior of the second wellbore tubular, wherein the wellbore tubular and the second wellbore tubular form parts of a wellbore tubular string;

a second flow restrictor disposed in the second fluid pathway;

a second actuation system comprising a second receiving antenna, wherein the second receiving antenna is configured to generate a second electric current in response to receiving a second electromagnetic signal having a second frequency; and a second sliding member disposed in series with the second flow restrictor in the second fluid pathway, wherein the second sliding member is transitional from a third position to a fourth position in response to the second electric current; wherein the second sliding member prevents fluid communication along the second fluid pathway when the second sliding member is in the third position, and wherein the second sliding member allows fluid communication along the second fluid pathway when the second sliding member is in the fourth position.

9. The well screen assembly of claim 8, wherein the first frequency and the second frequency are different.

10. A well screen assembly for use in a wellbore comprising:

a plurality of fluid pathways, wherein each fluid pathway of the plurality of fluid pathways is configured to provide fluid communication between an exterior of a wellbore tubular and an interior of the wellbore tubular, wherein two or more fluid pathways of the plurality of fluid pathways comprise:

an actuation system comprising a receiving antenna, wherein the receiving antenna is configured to generate an electric current in response to receiving a specific electromagnetic signal;

a flow restrictor disposed in at least one of the two or more fluid pathways; and a sliding member disposed in the corresponding fluid pathway, wherein the sliding member is transitional from a first position to a second position in response to the electric current; wherein the sliding member prevents fluid communication along the corresponding fluid pathway when the sliding member is in the first position, and wherein the sliding member allows fluid communication along the corresponding fluid pathway when the sliding member is in the second position.

11. The well screen assembly of claim 10, wherein the actuation systems in each of the two or more fluid pathways are configured to generate the electric current in response to specific electromagnetic signals having different frequencies.

12. The well screen assembly of claim 10, wherein the receiving antenna is physically tuned to the specific electromagnetic signal.

13. The well screen assembly of claim 10, further comprising a transmitter, wherein the transmitter is configured to transmit the specific electromagnetic signal to at least one corresponding receiving antenna.

14. The well screen assembly of claim 10, wherein at least one receiving antenna is configured to not generate an electric current in response to the transmitter transmitting the specific electromagnetic signal to the at least one corresponding receiving antenna.

15. A method comprising:

preventing, by a first sliding member, fluid flow through a first fluid pathway in a well screen assembly, wherein the first fluid pathway is configured to provide fluid communication between an exterior of a wellbore tubular and an interior of the wellbore tubular;

inductively coupling, by a first receiving antenna, with a first transmitting antenna that is transmitting a first signal;

generating a first electric current in the first receiving antenna in response to receiving the first signal;

translating the first sliding member using the first electric current; and allowing fluid flow through a flow restrictor is disposed in the first fluid pathway in response to the translating of the first sliding member.

16. The method of claim 15, further comprising:

preventing, by a second sliding member, fluid flow through a second fluid pathway in the well screen assembly, wherein the second fluid pathway is configured to provide fluid communication between the exterior of a wellbore tubular and an interior of the wellbore tubular and wherein the second fluid pathway is disposed in parallel with the fluid pathway;

inductively coupling, by a second receiving antenna, with a second transmitting antenna that is transmitting a second signal;

generating a second electric current in the second receiving antenna in response to receiving the second signal;

translating the second sliding member using the second electric current; and allowing fluid flow through the second fluid pathway in response to the translating of the second sliding member.

17. The method of claim 16, wherein the first transmitting antenna and the second transmitting antenna are disposed in one transmitter.

18. The method of claim 16, wherein the first signal and the second signal have different frequencies.

* * * * *